US005836016A

United States Patent [19]

Jacobs et al.

[11] Patent Number: 5,836,016

[45] Date of Patent: Nov. 17, 1998

[54] METHOD AND SYSTEM FOR REDUCING DRAG ON THE MOVEMENT OF BLUFF BODIES THROUGH A FLUID MEDIUM AND INCREASING HEAT TRANSFER

[76] Inventors: David L. Jacobs, 4825 Sixth St., Boulder, Colo. 80304; Eric L. Eagen, 7970 S. Cedar Cir., Littleton, Colo. 80120; Jeffrey J. Rogers, 11236 W. Arbor Dr., Littleton, Colo. 80127

[21] Appl. No.: 580,121

[22] Filed: Feb. 2, 1996

Related U.S. Application Data

[60] Provisional application No. 60/003,400, Sep. 2, 1995.

[51] Int. Cl.[6] ..... A41D 13/00

[52] U.S. Cl. ..... 2/69; 2/1

[58] Field of Search ..... 2/69, 70, 79, 67, 2/80, 227, 228, 238, 115, 108, 1

[56] References Cited

U.S. PATENT DOCUMENTS

| | | |
|---|---|---|
| 2,946,713 | 7/1960 | Dusina, Jr. et al. . |
| 3,070,476 | 12/1962 | Miller . |
| 3,184,184 | 5/1965 | Dorman et al. . |
| 3,257,263 | 6/1966 | Miller . |
| 3,835,470 | 9/1974 | Greiter . |
| 4,075,714 | 2/1978 | Ryder et al. . |
| 4,173,930 | 11/1979 | Faires, Jr. . |
| 4,195,362 | 4/1980 | Rolando . |
| 4,220,299 | 9/1980 | Motter . |
| 4,564,959 | 1/1986 | Zahn . |
| 4,690,847 | 9/1987 | Lassiter et al. . |
| 4,734,306 | 3/1988 | Lassiter . |
| 4,739,522 | 4/1988 | Lassiter et al. . |
| 4,807,303 | 2/1989 | Mann et al. . |
| 4,810,558 | 3/1989 | Hornung et al. . |
| 4,972,522 | 11/1990 | Rautenberg . |
| 5,033,116 | 7/1991 | Itagaki et al. . |
| 5,052,053 | 10/1991 | Peart et al. . |
| 5,106,331 | 4/1992 | Lizarazu . |
| 5,114,099 | 5/1992 | Gao . |
| 5,171,623 | 12/1992 | Yee . |
| 5,200,573 | 4/1993 | Blood . |
| 5,284,332 | 2/1994 | DiTullio . |
| 5,289,997 | 3/1994 | Harris . |
| 5,380,758 | 1/1995 | Rautenberg . |

OTHER PUBLICATIONS

"Mathematical Models of Running", *American Scientist,* vol. 82, Nov.–Dec. 1994, p. 551.

*Primary Examiner*—Gloria M. Hale
*Attorney, Agent, or Firm*—Holland & Hart LLP

[57] ABSTRACT

A method and system for reducing drag on the movement of the human body through air or other fluid mediums and improving heat transfer including a placement of trip mechanisms at predisposed locations on the human body with the mechanisms constituting elongated protrusions adapted to intercept the laminar flow of fluid across the body and prematurely trip the laminar flow into turbulence whereby the downstream pressure on the body is increased allowing the body to move more freely through the fluid medium.

43 Claims, 19 Drawing Sheets

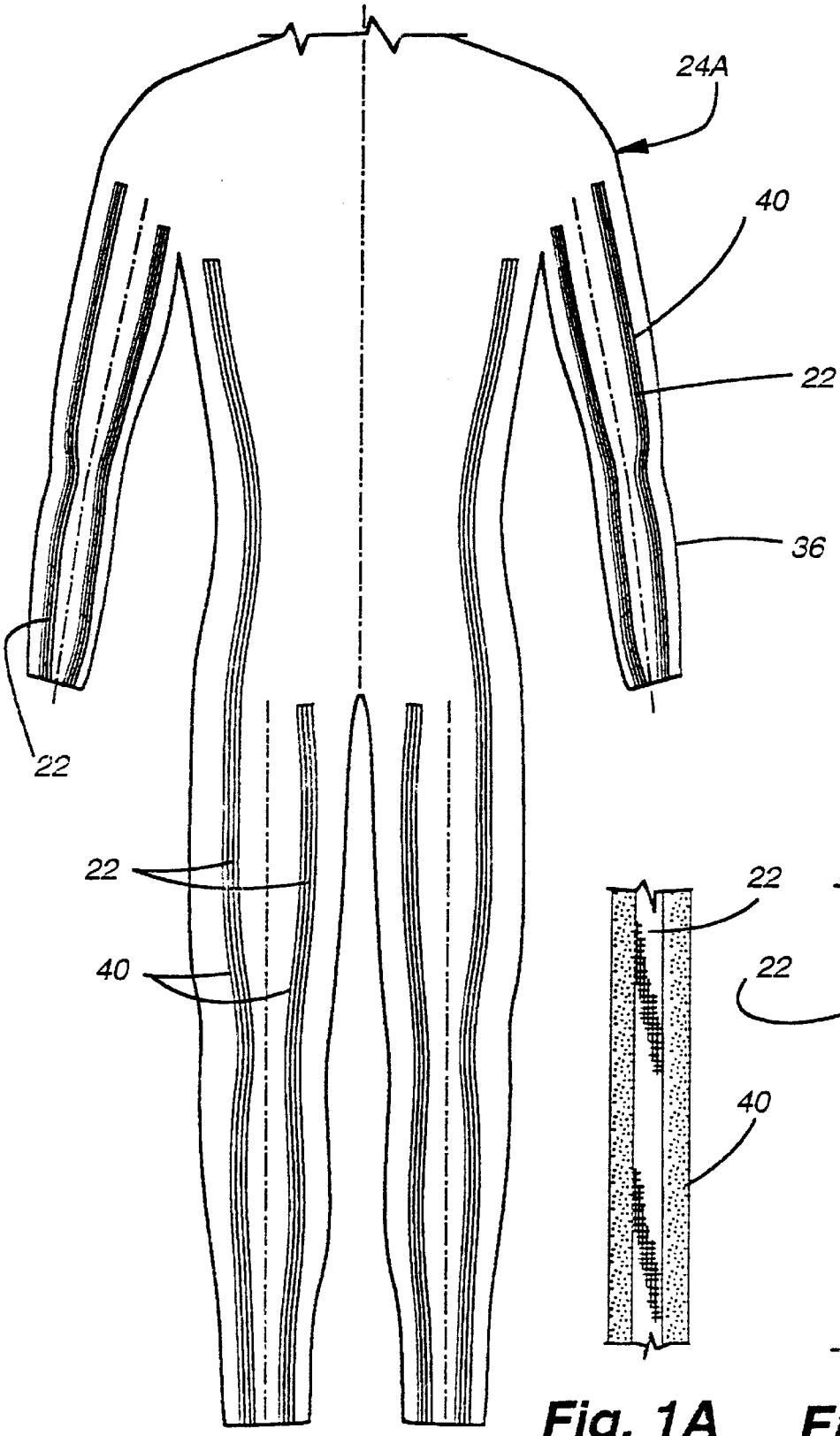
Fig. 1
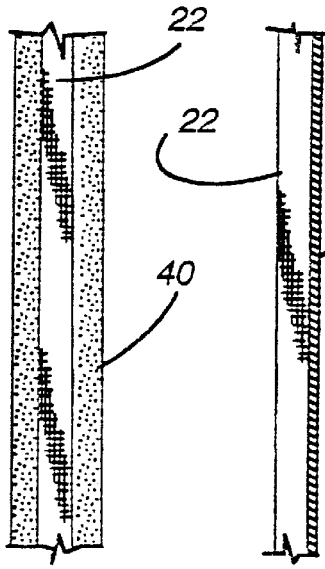
Fig. 1A
Fig. 1B

METHOD AND SYSTEM FOR REDUCING DRAG ON THE MOVEMENT OF BLUFF BODIES THROUGH A FLUID MEDIUM AND INCREASING HEAT TRANSFER

BACKGROUND OF THE INVENTION

1. Field Of The Invention

The present invention, as disclosed in Provisional Appl. 60/003,400, 9/02/95 relates generally to improving the aerodynamic conditions on objects moving through fluid mediums and more particularly to a method and system for (1) reducing aerodynamic drag on athletes, (2) increasing aerodynamic lift and stability on athletes and/or (3) increasing the athlete's ability to transfer heat away from the body. The effect is attained by providing trip mechanisms at preselected locations along the athlete's body to prematurely trip the boundary layer of fluid medium around the body from laminar to turbulent flow thereby establishing a boundary that has more momentum and when properly applied achieves the aforementioned results.

2. Description Of The Prior Art

Athletic events where speed is the common denominator among winners is becoming more and more an event involving, not only a good and gifted athlete, but also ingenuity and high technology. This is evident by the equipment, i.e., clothing, shoes, wax, shapes, geometries, materials, designs, etc., currently being used by athletes as compared to an athlete of the 1950's. In today's sporting events the difference in first and second place is measured in milliseconds. This supports the fact that the best equipped athlete and the athlete that experiences less aerodynamic drag, increased aerodynamic lift, or increased heat dissipation capability will stand a better chance of winning an event.

There are two basic components of aerodynamic drag, namely (1) skin friction drag and (2) pressure drag. Fluid flow can be categorized as viscous or inviscous, laminar or turbulent, and compressible or incompressible. The fluid flow about an athlete is considered viscous and incompressible and depending on the speed of the sport and the geometry of the body part, the flow is laminar or turbulent. For a body in a viscous flow, a boundary layer exists near the body. Only in the boundary layer are the effects of the fluid viscosity important. In this boundary layer there is a velocity profile (relative to the body) of the fluid ranging from zero at the surface of the body to a free stream velocity at a finite distance from the body. The finite distance from the body to the point where the fluid velocity equals the free stream velocity is termed the boundary layer thickness and is a function of velocity and geometry. The velocity gradient in this boundary layer results in a shear stress acting between differential layers of fluid. This is the origin of the skin friction drag component. The boundary layer in turbulent flow is thicker than that for a laminar flow and as a result the turbulent boundary flow possesses more momentum than a laminar boundary flow. Reducing the skin friction on a body tends to reduce the thickness of the boundary layer, i.e. minimizes the viscous forces acting on the body.

The pressure drag component is possibly best illustrated by reference to the fact that a circular cross-section will experience a much higher drag force than a well-streamlined body that has the same projected area into the flow stream. This is because the circular body leaves behind a large wake whereas the streamlined body has only a small wake if any. The larger the wake the larger the drag force. The fluid pressure in the wake of the body is lower than the fluid pressure acting on the front of the body thus a force resulting from the pressure differential resists the motion of the body. This force is termed pressure drag. The dominating drag component on a bluff body is, in the velocity ranges in which most athletes compete, the pressure drag component.

By overcoming the skin friction drag and pressure drag on the body of an athlete, the athlete's performance can be enhanced where speed is important to performance. Similarly, in events such as ski jumping, increased speed in addition to the lift and stability experienced by an athlete has a direct bearing on how far the athlete can fly before gravity returns the athlete to ground level. It is also well known that increasing an athlete's heat dissipation capability during performance, within bounds, enhances the athlete's performance.

The present invention has been made to achieve advantageous effects on an athlete caused by the afore-noted normally occurring aerodynamic characteristics as the athlete moves through a fluid medium.

SUMMARY OF THE INVENTION

The present invention relates primarily to a method and a system for reducing aerodynamic drag on an athlete's body as the athlete moves through a fluid medium. The reduced drag increases the athlete's speed through the fluid medium. The principles of the invention are also applicable to increasing aerodynamic lift on the athlete's body. As will also be appreciated with the description that follows, the manner in which the aerodynamic drag is reduced creates an improved heat transfer medium which permits an increase in heat dissipation capabilities, thereby enhancing athletic performance.

The method and system for reducing aerodynamic drag is embodied in prematurely tripping the laminar boundary layer of fluid passing around the athlete's body from laminar flow to turbulent flow by providing trip mechanisms on the athlete's body at predetermined locations. It has been found that by prematurely tripping the boundary layer of fluid flow around the athlete's body from laminar to turbulent, the pressure differential across the athlete's body can be reduced, thereby reducing the resistance to the movement of the athlete's body through the fluid medium. The trip mechanism can be releasably bonded or otherwise connected directly to the athlete's body or provided in or on a garment that the athlete would wear.

Such a trip mechanism can increase the pressure on the downstream side of a body, thereby minimizing the pressure differential across the athlete's body. Not only can the athlete's body be enabled to move through the fluid medium with less resistance but by properly placing the trip mechanism, aerodynamic lift and stability can also be obtained. Accordingly, selective placement of trip mechanisms on the athlete's body are determined by the desired movement of the athlete's body through the fluid medium.

It is also known that a turbulent boundary layer is more capable of carrying heat away from an athlete's body than a laminar boundary layer. Since a turbulent flow is established prematurely by the trip mechanism the system provides a more efficient means for transferring heat from the athlete's body, thereby improving athletic performance.

In addition to tripping mechanisms, an athletic garment incorporating features of the present invention is designed so as to have a plurality of riblets, i.e., small parallel ridges extending in a preselected direction around the athlete's body. The riblets channel the turbulent flow in the boundary layer such that vortices of the fluid resulting from the turbulent flow do not interfere with adjacent vortices whereby the riblets reduce energy losses caused by disorganized turbulence. Research shows this assists in maintaining an attached fluid layer to the body (reducing the size of the wake) and obtaining a relatively high pressure behind the athlete's body as it moves through the fluid medium.

BRIEF DESCRIPTION OF THE DRAWINGS

FIG. 1 is a fragmentary diagrammatic front elevation of a human body for an athlete incorporating boundary layer trip mechanisms secured thereto in accordance with the present invention.

FIG. 1A is a fragmentary front elevation of a trip mechanism in accordance with the present invention, incorporated into a strip of adhesive for direct application to the skin or garment of an athlete as shown in FIG. 1.

FIG. 1B is a fragmentary side elevation of the trip mechanism and strip of adhesive illustrated in FIG. 1A.

FIG. 2-2 is an enlarged view of a portion of the garment in FIG. 2-1.

DESCRIPTION OF THE PREFERRED EMBODIMENT

Before specifically describing preferred embodiments of the present invention, it is deemed helpful to provide some background on fluid flow as it relates to interaction with bluff bodies. A bluff body is a body, whose cross-sectional geometry normal to the direction of fluid flow is nonstreamlined or not aerodynamic in shape, i.e., circular, elliptical, square, blunt-faced, blunt-ended, etc. The human body can be viewed as a conglomeration of several bluff bodies.

There are two drag forces prevalent on a body moving through a fluid medium with these forces being pressure drag and friction drag. Pressure drag results from a low-pressure zone (the wake) being created downstream of a body moving through a fluid medium while friction drag relates more to the viscosity of the fluid and its drag along the sides of the body as the fluid moves across the body. Friction drag has a gradient with the shear stress between the differential fluid layers being greatest at the surface of the body and least at the outer layer of the boundary layer of fluid affected by the body. It is well known that the fluid boundary layer in laminar flow along a body is thinner and thus has less mass or momentum than the boundary layer of turbulent flow. Of course, turbulent flow results where a smooth laminar flow can no longer be maintained and tiny vortices in the fluid are created and propagate downstream.

The point at which the laminar flow of the boundary layer changes to turbulent flow is important to an understanding of the present invention and varies depending upon numerous parameters such as the size and shape of the body moving through the fluid, the viscosity and velocity of the fluid, the characteristics of the surface on the body, etc.

Figure 3:
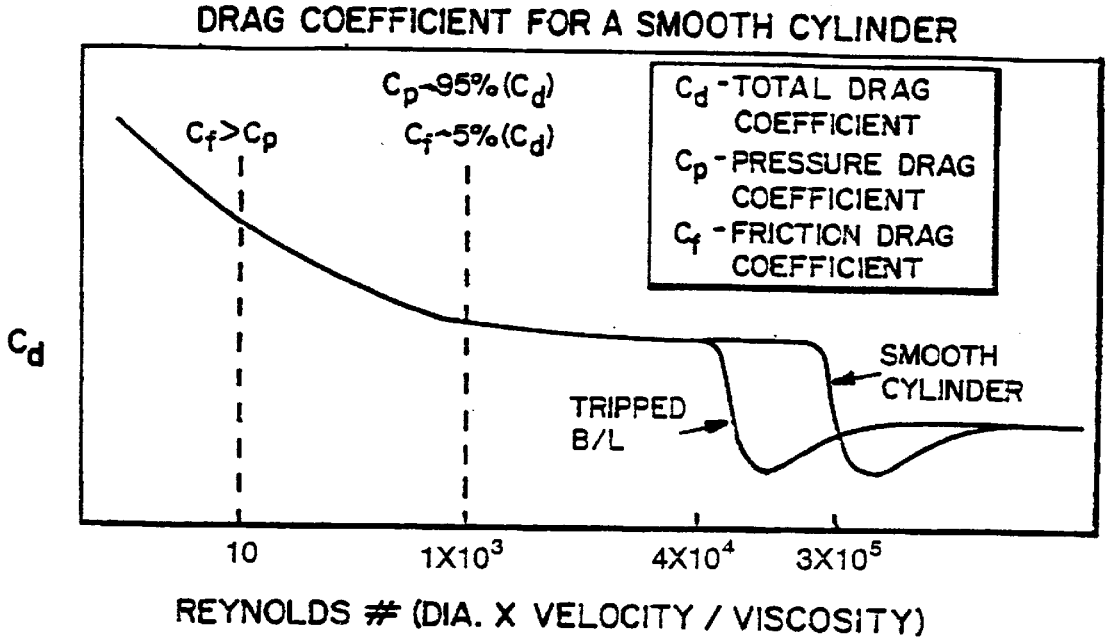
FIG. 3 is a graph illustrating drag coefficient for smooth cylinders and a cylinder with a prematurely tripped boundary layer as a function of Reynolds numbers. It also illustrates the proportions of friction and pressure drag to the total drag as a function of the Reynolds number.

The Reynolds Number (Re) is a commonly used dimensionless parameter expressing the ratio of inertia to viscous forces used to characterize a fluid in flow. The relative effects of skin friction and pressure drag as a function of Re for a cylinder are depicted in FIG. 3. It is important to note that at low Re the dominating drag component is skin friction. However, as the Re increases the contribution of skin friction drag to the overall drag decreases to a minimal amount. By way of example at Re of $1\times10^3$, approximately 5% of the drag is due to skin friction drag while the remaining contribution, approximately 95%, is due to the pressure drag component.

Figure 5:
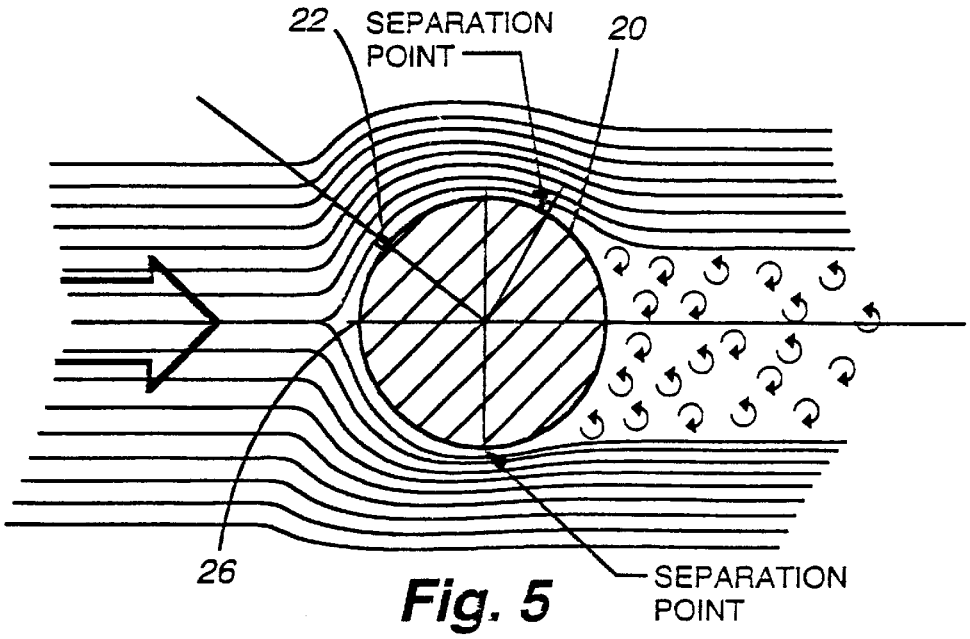
FIG. 5 is a diagrammatic view similar to FIG. 4 where a single trip mechanism is placed on the surface of the cylinder to illustrate the reduced size of the wake as a result of the trip wire.
Figure 4:
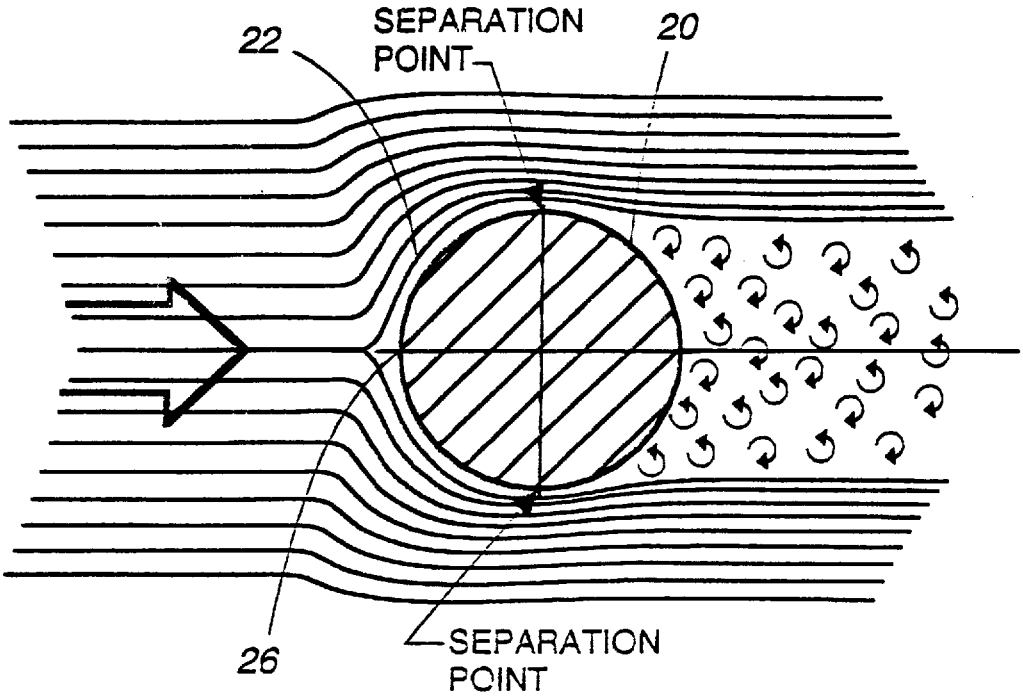
FIG. 4 is a diagrammatic transverse cross-sectional representation of a cylindrical body in a fluid stream in laminar flow with separation at around 90° from the stagnation line.
Figure 4A:
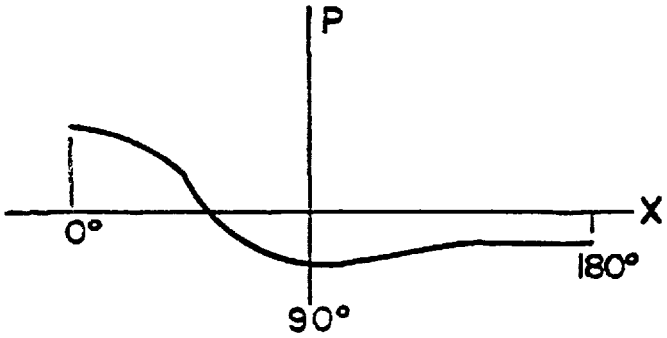
FIG. 4A is a graphical illustration of the local fluid pressure as a function of angular location across a cylindrical body that is not provided with a trip mechanism in accordance with the present invention.
Figure 6:
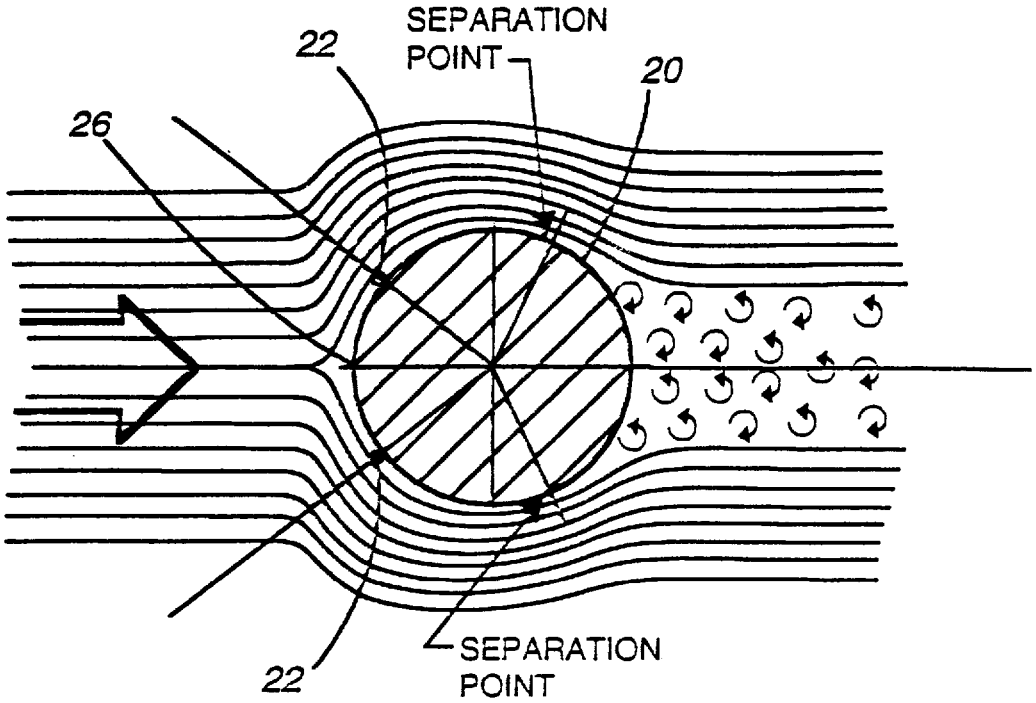
FIG. 6 is a view similar to FIG. 5 illustrating the use of two trip mechanisms and the added reduction in the size of the wake.
Figure 6A:
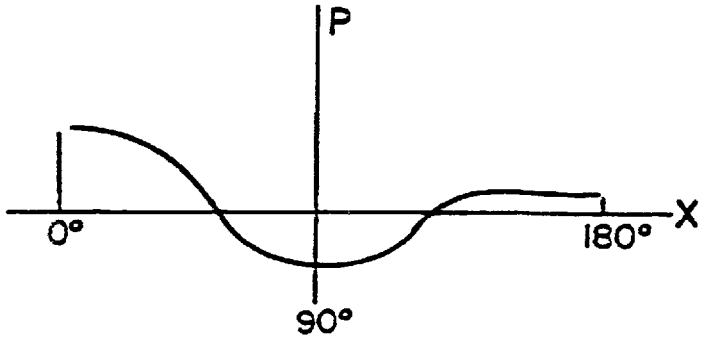
FIG. 6A is a graph similar to FIG. 4A illustrating the local fluid pressure change across the body when a pair of trip mechanisms, in accordance with the present invention, are utilized.

The velocity at which some athletes perform places the Reynolds number of their body parts greater than 1000. As will be appreciated by reference to FIG. 3, the drag coefficient drops off dramatically when Re is approximately $3\times10^5$ for a smooth cylinder. This is referred to as the Critical Reynolds Number and is physically when the boundary layer around the cylinder transitions from laminar to turbulent flow. When the boundary layer is prematurely tripped from laminar to turbulent flow, using a trip mechanism in accordance with the present invention, this transition occurs at a much earlier Re, i.e., approximately $4\times10^4$ rather than approximately $3\times10^5$. Since the turbulent boundary layer possesses more mass and momentum, it resists adverse pressure gradients better and separation of the boundary layer from the body occurs further downstream, resulting in a smaller wake and thus higher average pressure acting on the downstream side of the body, reducing pressure drag. This is best illustrated in FIG. 4 where the normal movement of a cylinder 20 of circular cross-section through a fluid medium is seen to create turbulent fluid flow downstream of the cylinder and separation of the boundary layer occurs at about 90° relative to the direction of movement of the fluid medium. The turbulence behind the cylinder is large and thus, generates a relatively large low pressure zone or wake behind the cylinder. FIG. 5 illustrates the amount of turbulence that occurs when the boundary layer is prematurely tripped with a single trip mechanism 22 to be described in more detail later. It can there be seen that the point of separation of the boundary layer on the side where the trip mechanism is positioned occurs at about 120° relative to the direction of movement of the fluid medium. FIG. 6 is a similar representation with a pair of trip mechanisms 22 in accordance with the present invention and it will be appreciated that the turbulent wake is much smaller yet due to 120° separation on both sides of the cylinder and thus the average fluid pressure acting on the downstream side of the object is increased. A graphic but approximate illustration of this phenomena is shown in FIGS. 4A and 6A, respectively.

Figure 7:
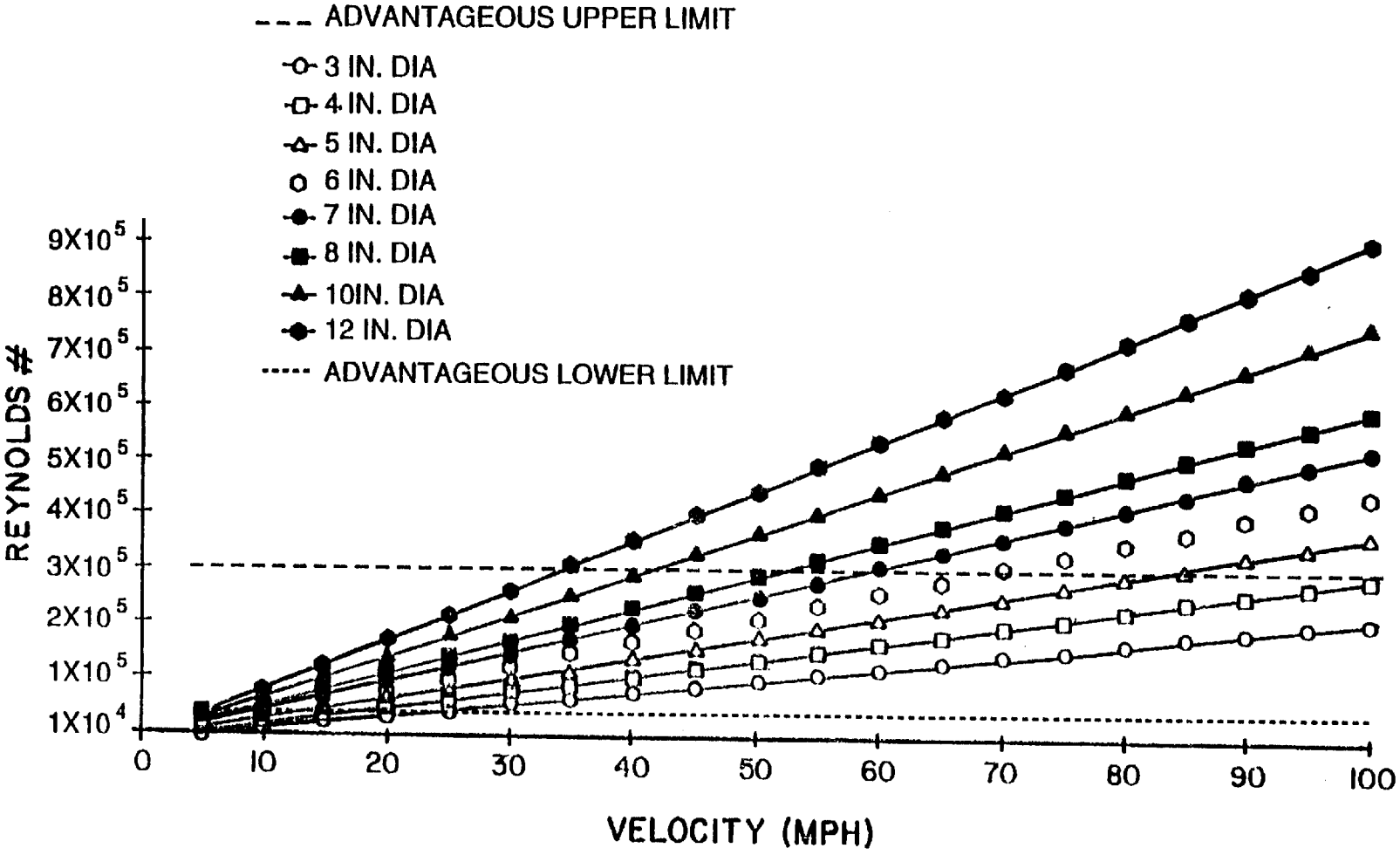
FIG. 7 is a graph plotting Reynolds numbers relative to fluid velocity for circular cylinders of varying diameters; the region of advantages is also depicted.

FIG. 7 is another graphical representation of the relationship of the diameter of a cylindrical body moving at various velocities and the resultant Reynolds Numbers. This graphic shows how the Reynolds Number increases both with relative fluid velocity and the diameter of the cylindrical body. The advantageous upper and lower limits evolving from use of the present invention are also illustrated. It should be noted that at a Re of around $3\times10^5$, for a circular cylinder, the boundary layer becomes turbulent without any tripping mechanism. This, as mentioned previously, is known as the critical Reynolds number. When a trip mechanism is used on a smooth cylinder at Reynolds numbers greater than the critical Re, slight increased drag is observed.

In accordance with the present invention, and as mentioned previously, the boundary layer is prematurely tripped from laminar to turbulent with strategically positioned elongated trip mechanisms on the athlete's body causing the boundary layer to stay attached to the body longer creating a relative increase in the average pressure behind the athlete's body. These mechanisms can either be included in a garment 24B (FIGS. 2-1 and 2-2, 2A and 2B) that the athlete wears or can be adhesively bonded (FIGS. 1, 1A and 1B) to the athlete's body 24A at preselected locations as will be described in more detail later.

In determining these locations, tests have been performed on cylindrical bodies which, of course, are not identical in shape to the components of the human body, but can be used as a basis for determining where best to place the wires on the human body. Tests have also been performed on a mannequin leg simulating the human body leg as will be discussed later. In tests on cylindrical bodies, it has been found that a single trip mechanism in the form of an elongated protuberance or wire 22 extending longitudinally along the length of the cylindrical body at predetermined angular displacements from a stagnation line 26 and substantially parallel therewith, FIGS. 5 and 6, will prematurely trip the boundary layer of fluid from laminar to turbulent flow. The stagnation line is an imaginary line running longitudinally along the length of the cylinder along its foremost surface and in direct alignment with the line of movement of the cylinder through the fluid medium. On a circular cylinder, it has been found that a trip mechanism of a dimension to be described later located between 20 degrees and 60 degrees from the stagnation line (optimally 37 degrees), measuring from the center of the circle, will effectively trip the boundary layer from laminar to turbulent flow and reduce the pressure drag on the cylindrical body. However, if the trip mechanism is located at angles less than approximately 20 degrees from the stagnation line, there is virtually no effect on the overall drag and if the trip mechanism is located at angles greater than 60 degrees there is a slight increase in drag. Once the boundary layer is tripped the variation of drag reduction within the 20 degrees and 60 degrees bounds is small and, therefore, to allow for variations and body positions during an event, the trip mechanism is desirably located (on a perfect circular cylinder) at approximately 37 degrees from the stagnation line. This will provide maneuverability margins on either side of the trip mechanism.

It has been found that providing two equally sized trip mechanisms 22 (FIG. 6), one on either side of the stagnation line and within the afore-identified range of 20 degrees to 60 degrees from the stagnation line, provides even better drag reduction. For example, trip mechanisms can be placed at +30 degrees and at −30 degrees from the stagnation line and obtain more than twice the drag reduction of a single trip mechanism at 30 degrees to one side or the other from the stagnation line.

Figure 12:
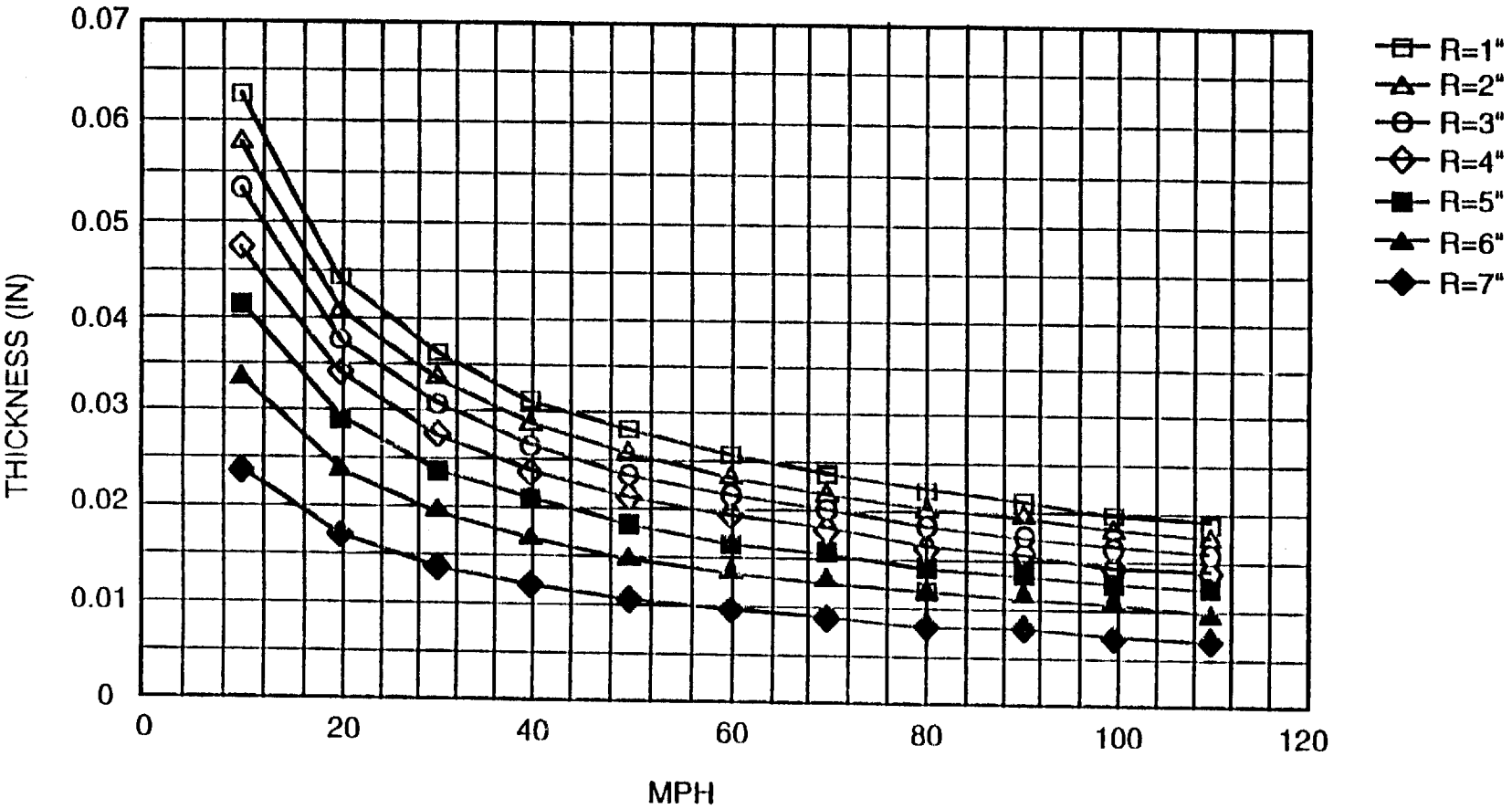
FIG. 12 is a graph comparing boundary layer thickness to fluid velocity for given body radiuses.

The cross-sectional size of the trip mechanism, i.e., its width or diameter, has an effect on the drag reduction. It is preferred that the trip mechanism be sized in cross-section to be within the boundary layer of fluid moving across the athlete's body. As mentioned previously, boundary layer varies in depth dependant upon body size and velocity. FIG. 12 is a graph plotting boundary layer depth to velocity for various sized cylindrical bodies with the radius of the body being designated "R". From the graph the maximum mechanism diameter can be determined by keeping the mechanism diameter less than the boundary layer depth. In other words, for a particular athletic event where one can determine the anticipated fluid velocity and the size of a given body part, the maximum diameter of the trip mechanism to be used can be determined.

Figure 8:
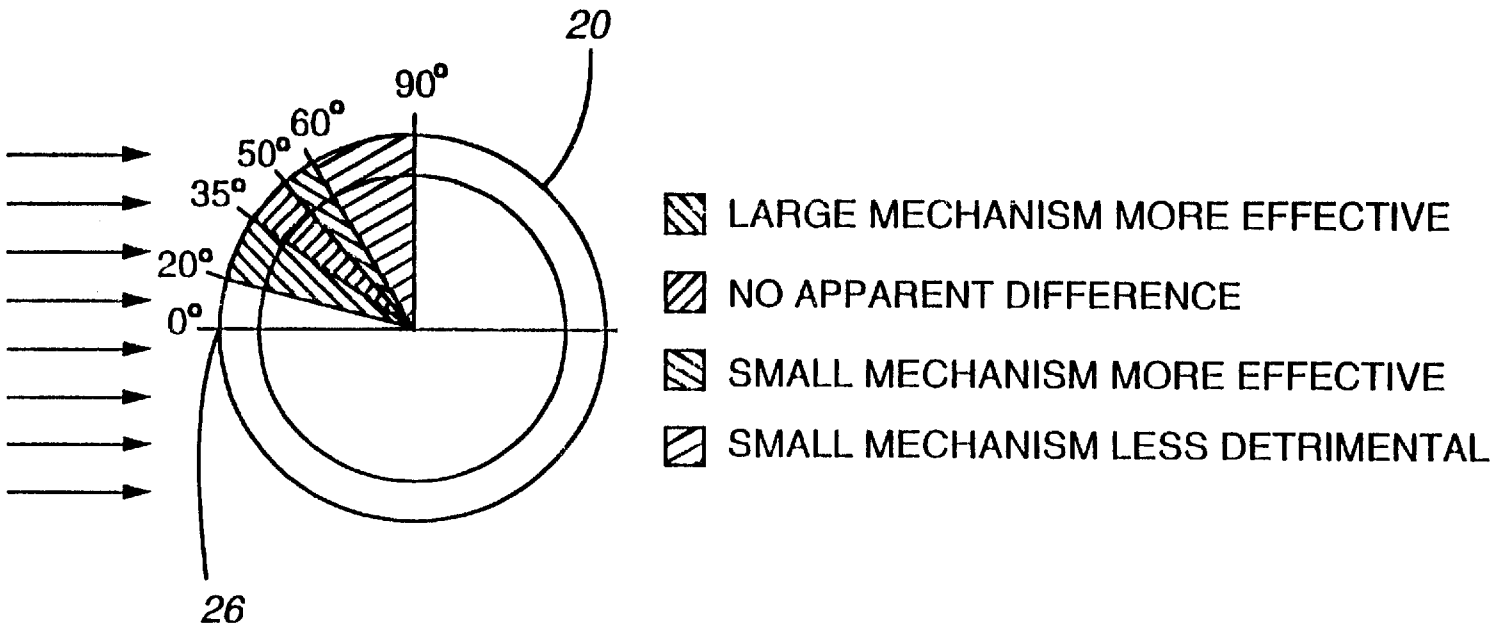
FIG. 8 is a graphical representation of effective zones for large and small trip mechanisms on a cylinder.

In addition, large mechanisms, for example (approximately 0.05 to 0.13 inches in diameter) appear to reduce drag more effectively than small mechanisms (0.02 to 0.05 inches in diameter) at about 20 degrees to 35 degrees from the stagnation line. There is no apparent differences between the large and small mechanisms at 35 degrees to 50 degrees from the stagnation line. The small mechanisms, however, appear to reduce drag more effectively from 50 degrees to 60 degrees. Further, the small mechanisms have slightly less negative impact from 60 degrees to 90 degrees than large mechanisms. This information is illustrated graphically in FIG. 8.

Figure 2:
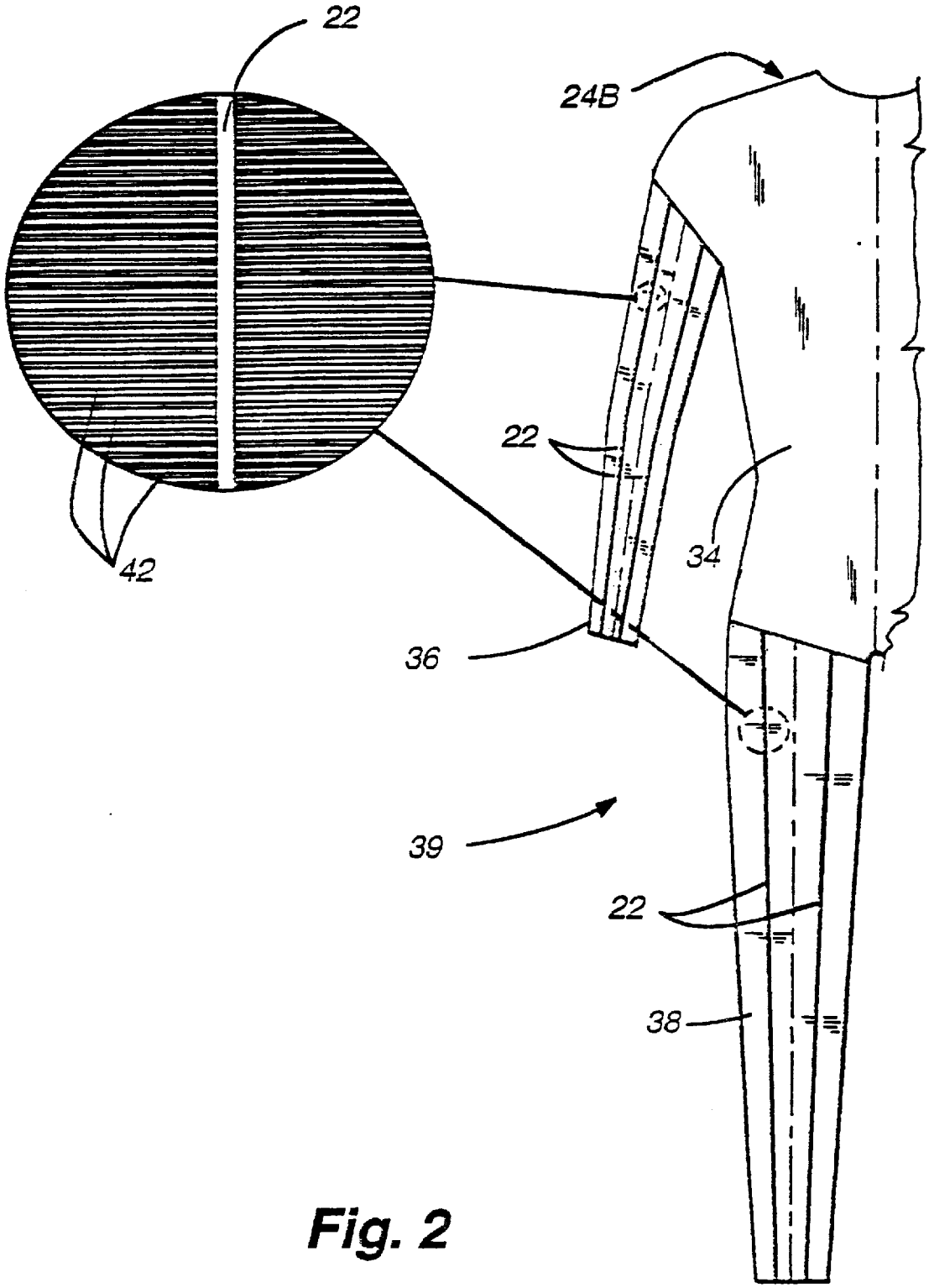
FIG. 2 is a fragmentary diagrammatic front elevation of a garment showing the use of trip mechanisms and riblets at various locations on the garment in accordance with the present invention.
Figure 2A:
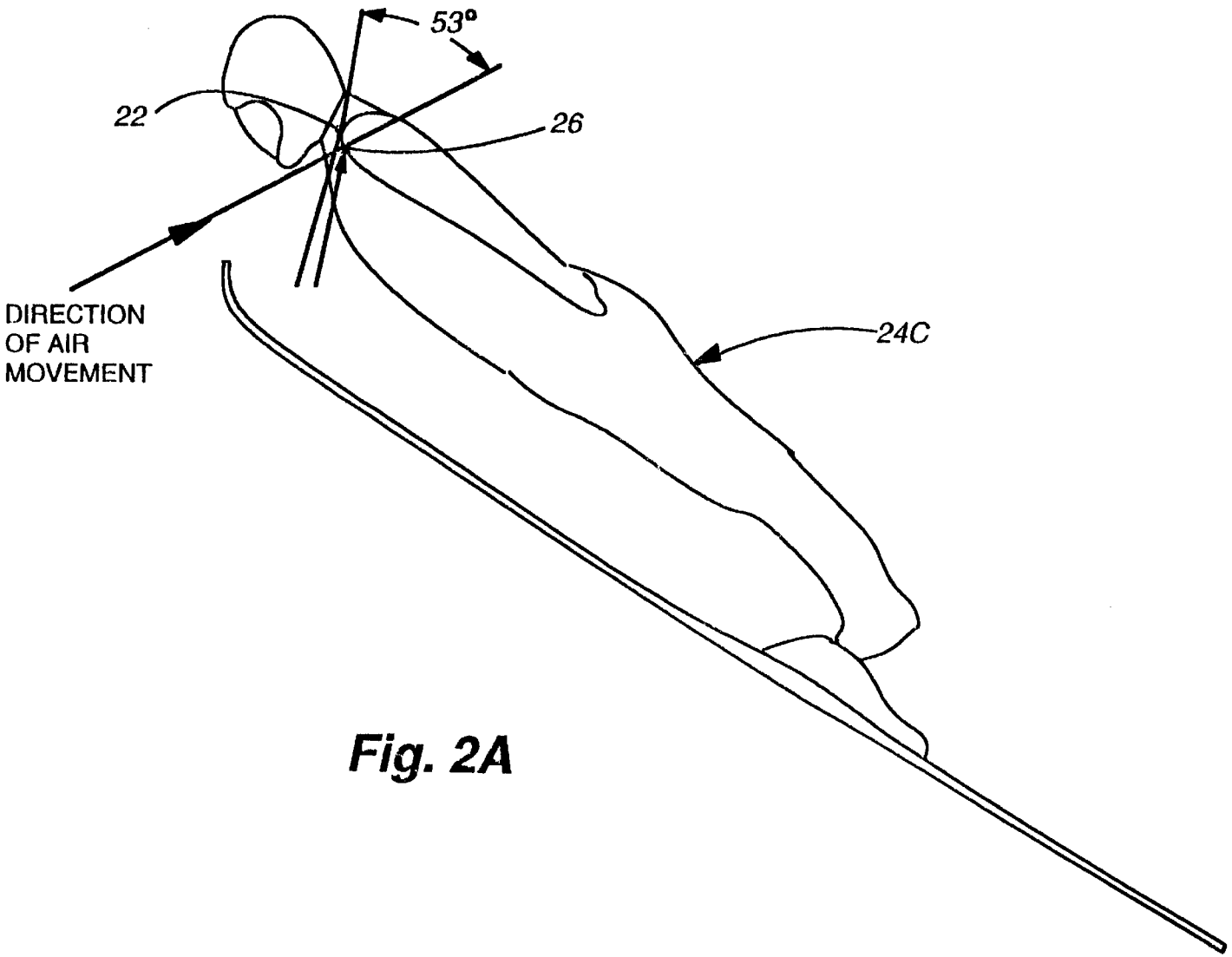
FIG. 2A is a diagrammatic side elevation of a ski jumper wearing a garment incorporating a shoulder trip mechanism in accordance with the present invention.
Figure 2B:
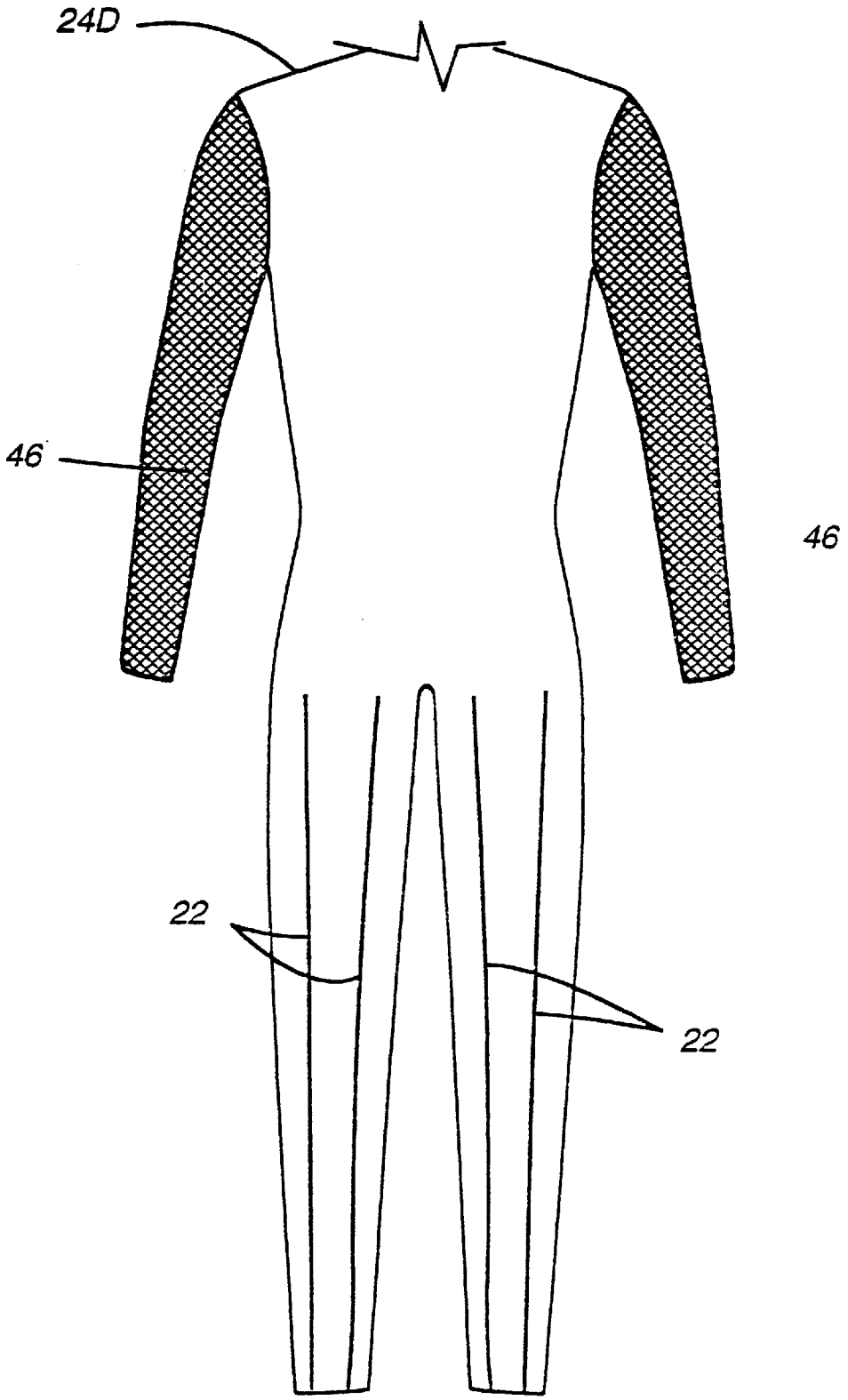
FIG. 2B is a fragmentary diagrammatic front elevation of a garment similar to that shown in FIG. 2-1 with the arms of the garment having netting as opposed to elongated trip mechanisms.
Figure 9:
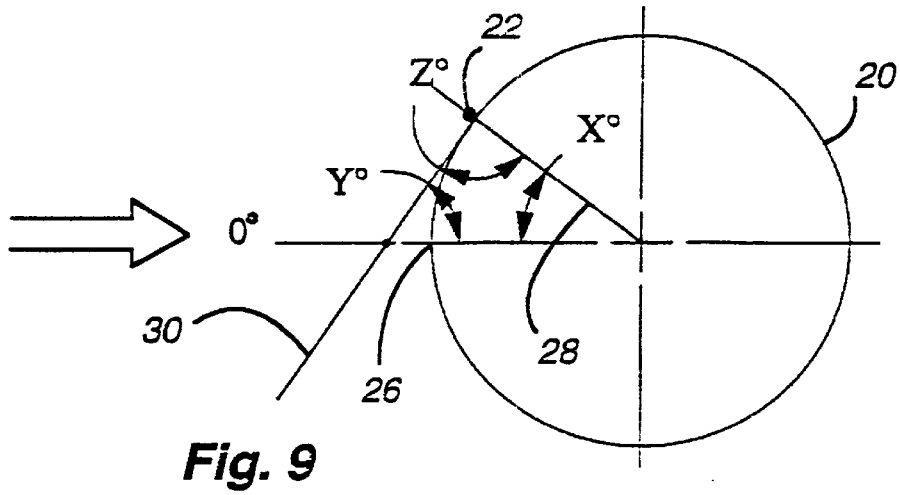
FIG. 9 is a geometrical representation of a circle showing angular relationships used to determine the slope of a tangent line at the location of a trip mechanism on a circle.
Figure 10:
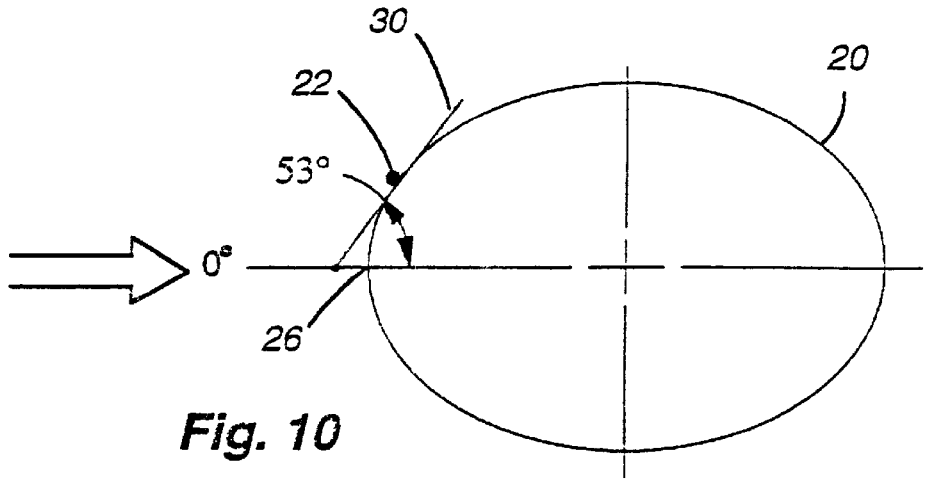
FIG. 10 is a geometric view similar to FIG. 9, of an oval with its major axis oriented in the direction of fluid flow illustrating how the same slope line used in FIG. 11 can optimally position the trip mechanism on the oval.
Figure 11:
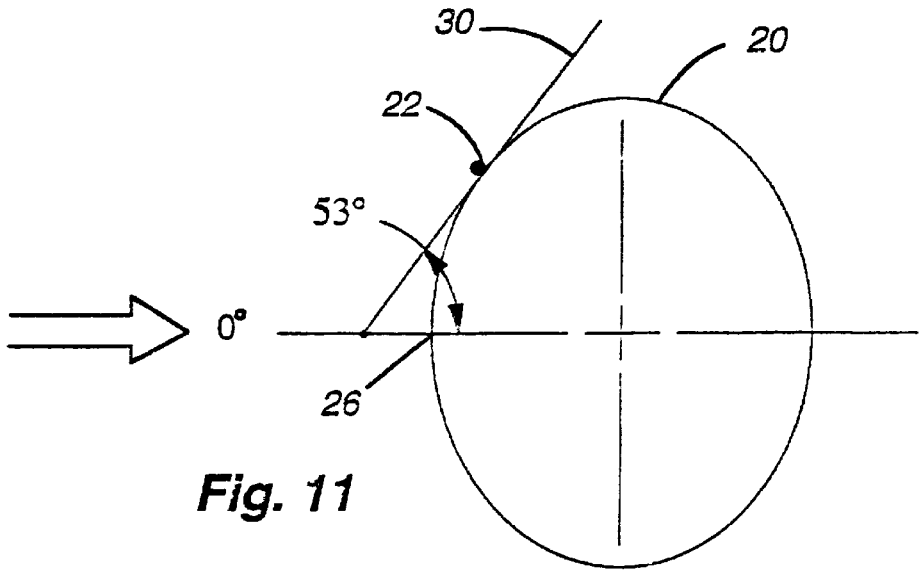
FIG. 11 is a geometric view similar to FIG. 10 showing how a slope line can optimally position a trip mechanism on an oval with its major axis located in the direction of fluid flow.

As mentioned previously, the human body does not consist of perfect circular cylinders and, therefore, the placement of trip mechanisms relative to stagnation lines will vary for optimal results and will not necessarily follow substantially straight lines as diagrammatically illustrated in FIGS. 1, 2 or 2B. Referring to FIGS. 9, 10 and 11, it will be appreciated that the tangential slope at a radius location can be used to convert the optimal positions identified above for circular cylinders to bodies of other than ovular configurations. By equating slopes, the optimal placement of a trip mechanism 22 can be determined for differently configured bodies such as the arms, legs, or torso of the human body.

As illustrated in FIG. 9 and as is a well-known fact of geometry, the sum of the angles inside a triangle equal 180 degrees. The angle between a radius line 28 drawn from the center of a circle and a tangent line 30 to the circle is always 90 degrees. If it is desired that the trip mechanism be positioned at 37 degrees from the stagnation line on a circle 26, the following would be true:

Angle X=37 degrees

Y=53 degrees

Z=90 degrees

Accordingly, no matter what the cross-sectional shape of the body, the angle between the line running parallel to the air flow and the line 30 tangent to the object will be 53 degrees. The tangent point on the circle, oval or other similarly shaped object is the location of the trip mechanism. FIGS. 10 and 11 illustrate the location of the trip mechanism 22 on two differently oriented oval-shaped bodies for illustrative purposes.

It follows that if the trip mechanism were to be placed in the range of 20° to 60° from the stagnation line for a circle measured from the center of the circle, the desired range for the angle of the tangent line (hereafter tangent equivalent) relative to a line parallel to the air flow would be 30° to 70°.

Referring next to FIG. 2-1 and 2-2, a garment 24B that could be worn by an athlete in accordance with the present invention can be seen to include a torso portion 34, arm portions 36 and leg portions 38 all integrated into a unified suit 39. The suit would preferably be skin tight and could be made of Spandex or other similar fabric. Incorporated into the suit are a plurality of protuberances or trip mechanisms 22 which can simply be metal wires, fiber cords or other protuberances that are stitched or otherwise affixed to the fabric of the suit or can be established in the fabric itself by forming ribs in the fabric such as by gathering the fabric along the predetermined trip line locations and stitching the fabric to itself so as to provide an elongated protuberance in the fabric along the trip line location. Other methods of forming the trip mechanism will be apparent to others skilled in the art but for purposes of the present disclosure, cords of a fabric or fiber material are preferably stitched into or onto the fabric so as to extend along the predetermined trip line locations.

In the garment 24B illustrated in FIG. 2-1 and 2-2, phantom lines are provided to represent stagnation lines 26 or aligned multiple stagnation points on the human body and trip mechanisms 22 have been incorporated into the suit at displacements from either side of the stagnation lines. There are stagnation lines along the front of each arm portion 36 and along the front of each leg portion 38 of the garment as well as along the center of the chest. It will be apparent, however, while not being illustrated, that pairs or dual trip mechanisms can be provided on either side of the stagnation lines at preselected angular displacements therefrom such as for example 30 degrees and 40 degrees on each side of the stagnation lines.

The trip mechanisms 22 do not have to be incorporated into a garment as they can be adhesively bonded or otherwise secured directly to the athlete's skin as shown in FIG. 1. The mechanisms can be secured to strips 40 of adhesive tape, as best shown in FIGS. 1A and 1B, and the strips of tape can be bonded to the skin at the preferred locations for the trip mechanisms.

The size of the trip mechanisms 22 can be identical or varied as can the displacement of the mechanisms from the stagnation line 26. Since large mechanisms appear to reduce drag more efficiently in the range of 20 degrees to 35 degrees from the stagnation line and small mechanisms are more efficient between 35 degrees and 50 degrees from the stagnation line, a large mechanism provided at a 30 degree displacement and/or a small mechanism at a 40 degree displacement might possibly provide for more optimal results. These locations would of course translate into 60° and 50° respectively for the tangent equivalent.

As will be appreciated, since a premature turbulent boundary layer turbulence is created by the trip mechanisms 22 and a turbulent boundary layer is known to be more capable of carrying heat away from an athlete's body, the trip mechanisms provide an efficient system for increasing heat transfer from an athlete's body, thereby improving athletic performance.

As mentioned previously, it has been found that by providing riblets 42 (FIG. 2-1 and 2-2), i.e., small parallel ridges in the fabric with the riblets extending preferably parallel to the predominant air flow, any turbulent flow inside the boundary layer along the fabric can be channeled. As mentioned previously, when turbulence exists in the boundary layer of fluid flowing across a body, tiny vortices are created and propagate downstream. Research shows that riblets channel the turbulent flow and reduce the amount of interference between adjacent vortices and, therefore, reduce energy losses to disorganized turbulence and maintain the boundary layer momentum. This allows the flow to remain attached to the body longer which reduces the size of the wake and thus the pressure drag. While the riblets could vary in size and spacing, peaks of the riblets are preferably not greater than 0.015 inches higher than a valley and the adjacent ridges or peaks protruding outwardly from the surface of the suit are preferably spaced approximately 0.003 to 0.007 inches. FIG. 2-1 and 2-2, illustrates the location and direction of riblets provided on a garment 24B and as will be seen, in the arm portion 36 and leg portion 38, the riblets extend around the limbs in relationship parallel to the fluid flow around the limbs. Riblets may also be provided in the torso region while not being illustrated. The direction of the riblets in the torso region would vary depending on the athletic event and the location of trip mechanisms since the orientation of the athlete's torso varies for different athletic events.

As can be appreciated, by decreasing the relative pressure drop from the upstream side of the athlete's body to the downstream side, the athlete's body can move through the fluid medium more efficiently and with less drag. Another advantage of this concept resides in lift and stability which can be obtained for the athlete's body such as might be useful for ski jumpers, long jumpers, and the like. FIG. 2A illustrates a garment or suit 24C that can be worn by a ski jumper with additional trip mechanisms 22 located along each shoulder for purposes of illustration. The shoulder trip mechanisms would extend from the base of the neck to the outermost part of the shoulder and would desirably be placed along a line determined by a 53-degree slope from the stagnation line 26. The lift is obtained by moving the point of separation of the air flow rearwardly and changing the direction of the resultant force due to the momentum transfer of the fluid and body. Trip mechanisms 22 would also be placed (though not shown in FIG. 2A) on the garment as illustrated in FIG. 1 so as to allow the body to move more rapidly through the air medium whereby the ski jumper can cover more distance in a given amount of time as when traveling down the in-run of a ski jump and while in the air. Tripping the boundary layer to turbulent will also reduce vortex shedding and therefore provide stability for the jumper.

FIG. 2B illustrates a garment 24D in accordance with the present invention where a net material 46 of crisscrossing protuberances is used on the arm portions to prematurely trip the boundary layer. In some athletic events, such as downhill skiing, it is difficult to place the trip mechanism on body parts that do not have a fairly constant angular relationship to the air movement across the body. This of course is true for a skier's arms or helmet. Accordingly, while selectively placed trip mechanisms provide better drag reduction results on body parts with a fairly constant angular relationship to the air flow, a netting material such as found on women's net stockings has been found to effectively and prematurely trip the boundary layer for the body parts that do not maintain a fairly constant angular relationship to the air flow and accordingly, such netting material is shown in FIG. 2B used on or for the arm portions of the garment. Of course, such netting while not being illustrated could be placed over the athlete's head, helmet or other body parts as well.

Figure 13:
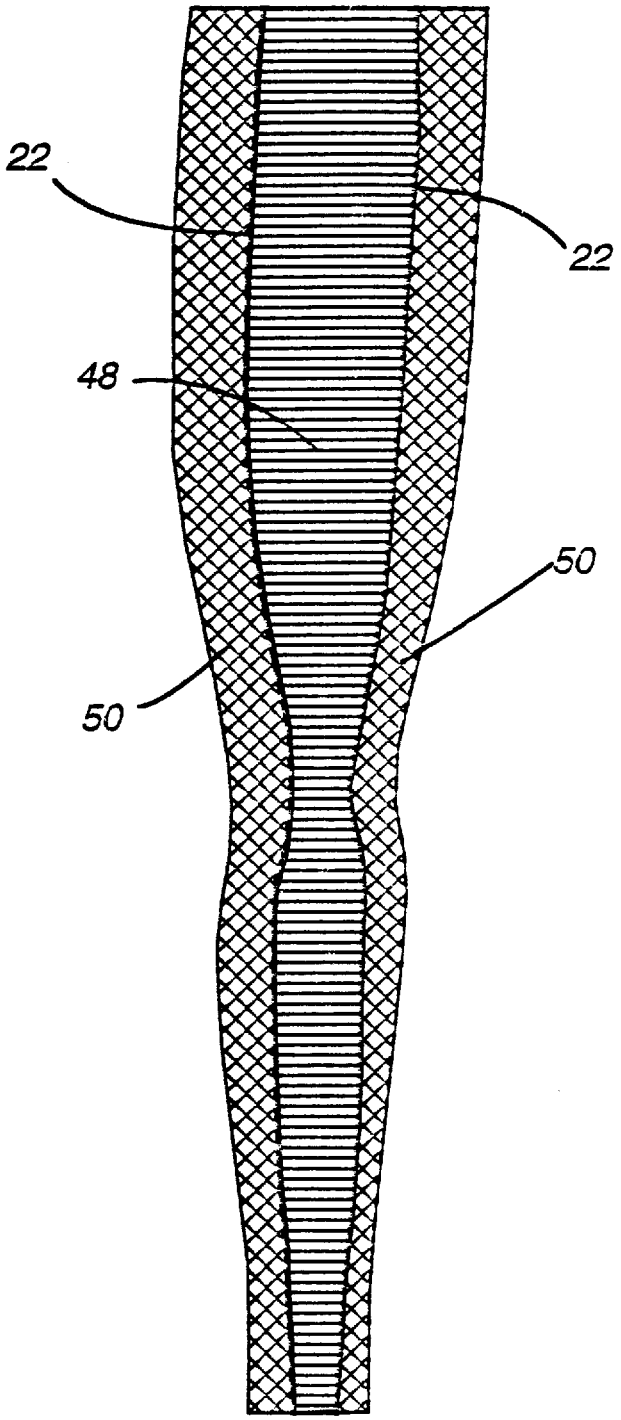
FIG. 13 is a diagrammatic front elevation of a human leg having a garment with double trip mechanisms, a front panel with riblets and mesh around the remainder of the leg.

To further enhance heat transfer from an athlete's body, a garment incorporating the trip mechanisms 22 could be formed, as illustrated in FIG. 13 in connection with a leg only, with preferably a stretch material 48 such as spandex along the stagnation line between trip mechanisms 22 and with the remainder of the garment being made of netting 50. In other words, the netting would be in the regions where air flow is tripped to turbulence providing best heat transfer and would further enhance the transfer of heat from the athlete's body to the ambient environment.

It will be appreciated from the above that an athlete's performance when related to speed, lift or heat transfer can be enhanced with the teachings of the present invention, i.e., through the use of strategically placed trip mechanism and riblets and/or netting on the athlete's body. Both the speed of movement of the athlete's body through the fluid medium and the ability of that body to travel longer through the fluid medium are both enhanced thereby providing considerable improvement to an athlete's performance in any athletic endeavor that involves speed and/or endurance.

In order to verify the afore-described improvements obtained through use of trip mechanisms on objects moving through fluid mediums, various tests were made in a wind tunnel where the conditions of the air movement could be controlled. In these tests, cylinders having a 4.2 inch diameter as well as a mannequin full-length leg were placed in the wind tunnel with various modifications in accordance with the present invention and in varied wind velocities. The 4.2 inch diameter cylinder was placed in the wind tunnel in a vertical orientation to determine the drag force on the cylinder at varying wind velocities thereby defining a Baseline from which to compare other data. The other data was derived after modifying the cylinder in various ways but in accordance with the present invention in attempts to reduce the drag force.

The cylinder was initially placed in the wind tunnel with no modifications and the results of those tests plotting wind velocity against drag force are defined as the Baseline. The Baseline data forms the basis for a comparison against test results obtained when modifications to the cylinder in accordance with the present invention were made. The Baseline tests showed the largest drag force on the cylinder and by adding a small mesh to the cylinder where the fibers were approximately 1/100" in diameter and crisscrossing to define openings wherein the mesh openings were approximately 3/8" square, a small improvement or reduction in drag force was obtained. The use of a large mesh again having approximately 3/8" square openings but formed from criss-crossing fibers approximately 1/64" in diameter, a slightly better improvement in drag force reduction was obtained. A radical improvement was obtained, however, by placing trip mechanisms in accordance with the present invention at plus and minus 35° relative to the stagnation line.

Figure 18:
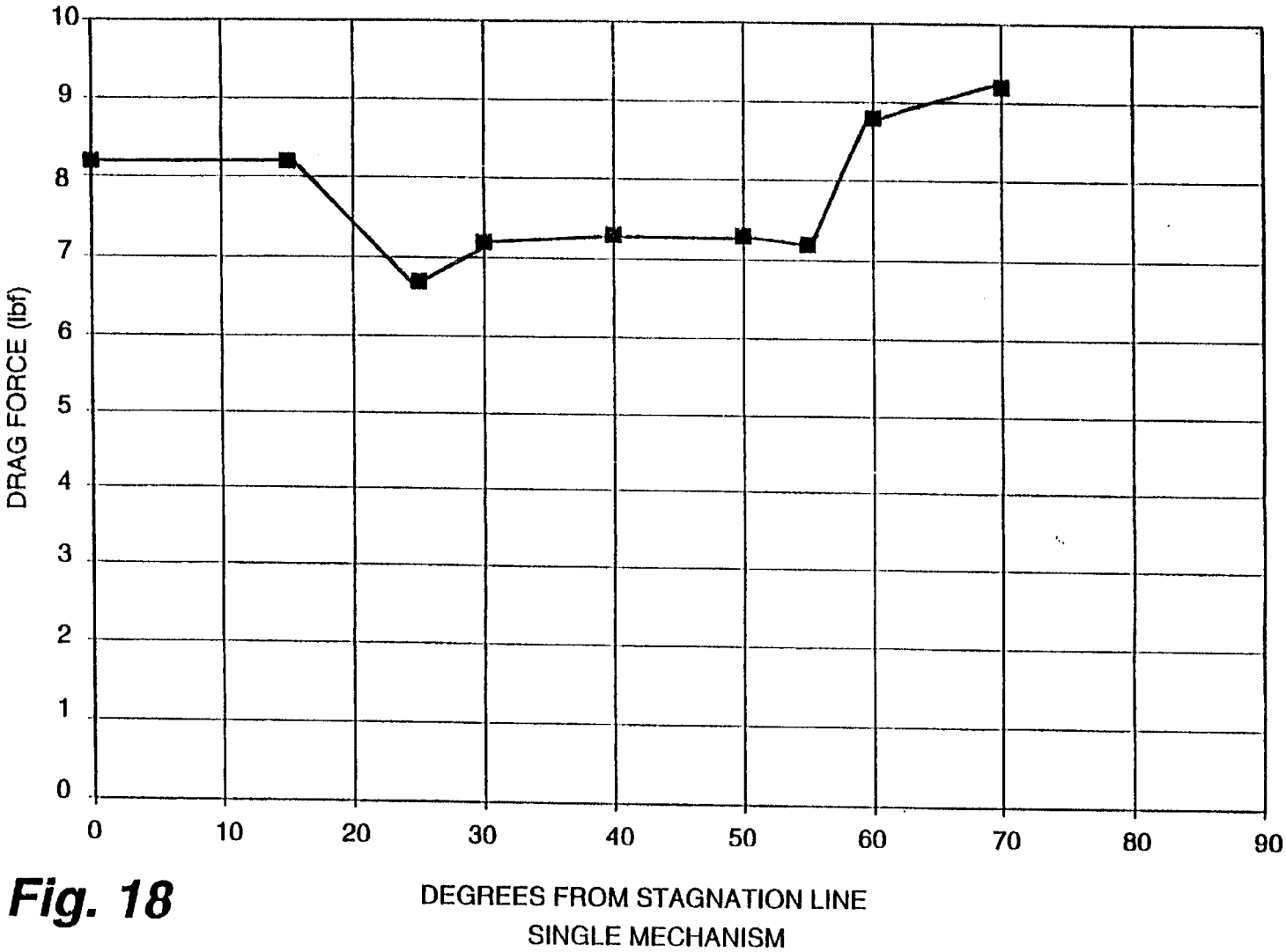
FIG. 18 is a graph illustrating the variations in drag force on a cylindrical tube having a single trip mechanism at various angular locations and with constant wind velocity.

FIG. 18 is a graph illustrating the variations in drag force resulting from various angular displacements of a single trip mechanism from the stagnation line of a cylinder with a constant wind velocity of 45 mph. It will be appreciated that a radical drop in drag force is obtained at approximately 17° displacement from the stagnation line and that a substantial increase is observed at approximately 59°.

Figure 15:
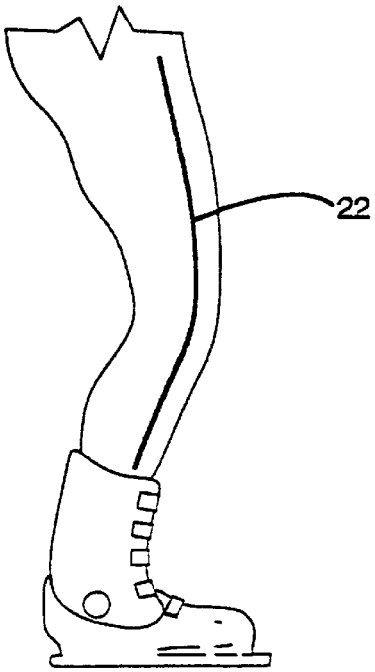
FIG. 15 is a fragmentary diagrammatic side elevation of a mannequin leg having a single trip mechanism extending along one side of a stagnation line substantially the entire length of the leg.
Figure 16:
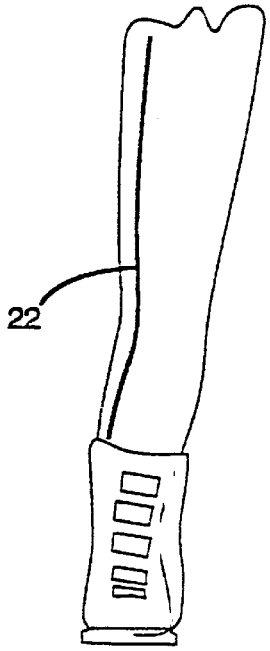
FIG. 16 is a fragmentary diagrammatic front elevation of the mannequin leg shown in FIG. 15.
Figure 14:
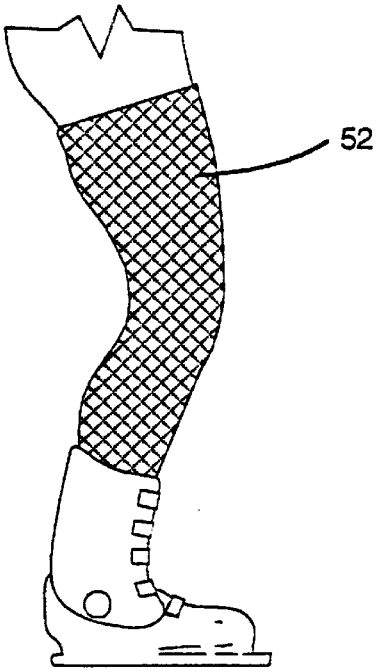
FIG. 14 is a fragmentary diagrammatic view of a mannequin leg having a ski boot with mesh covering the entire leg but not the boot.
Figure 21:
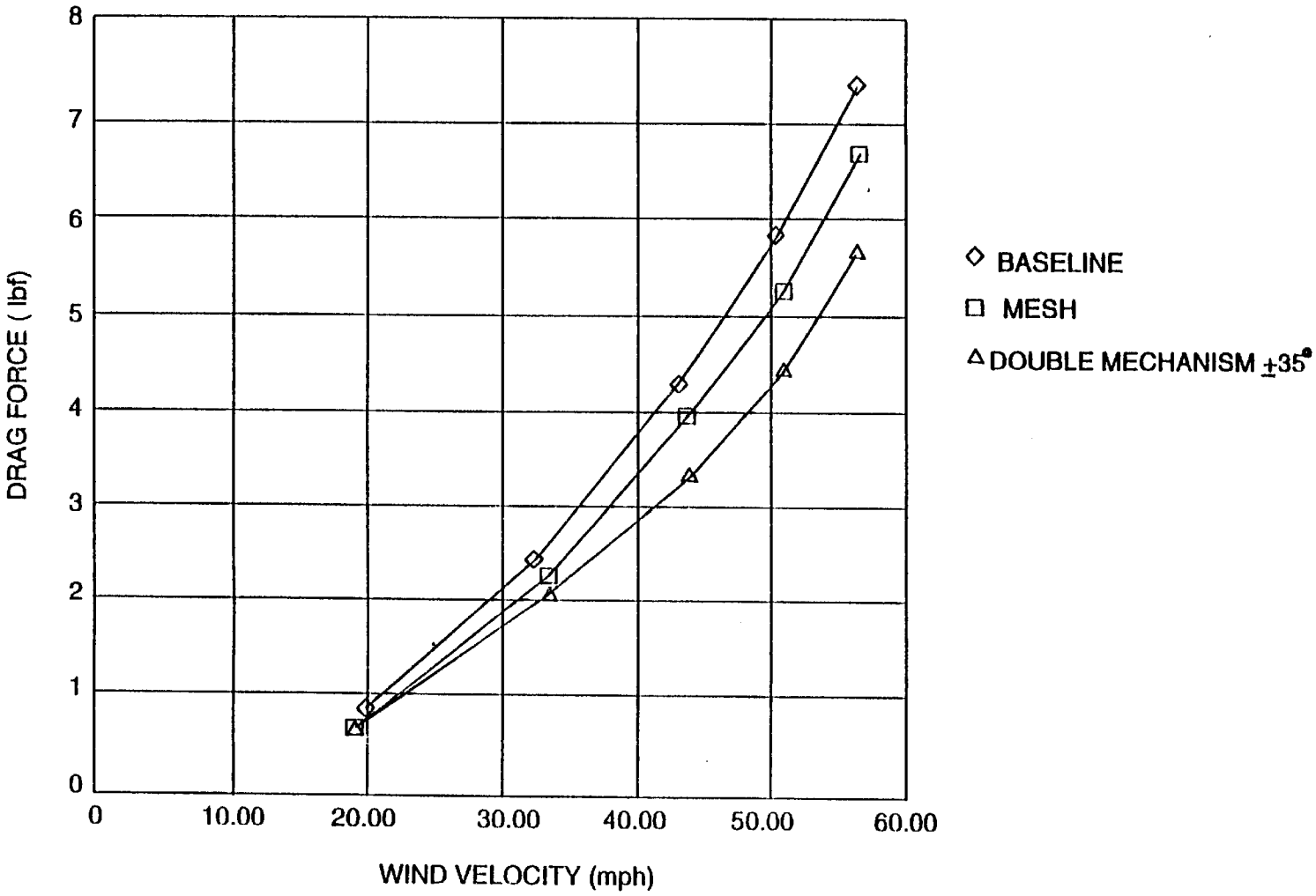
FIG. 21 is a graph illustrating the drag force at varying velocities and making different comparisons than those in FIG. 19 of a Baseline mannequin leg with a mannequin leg modified in accordance with the present invention.
Figure 22:
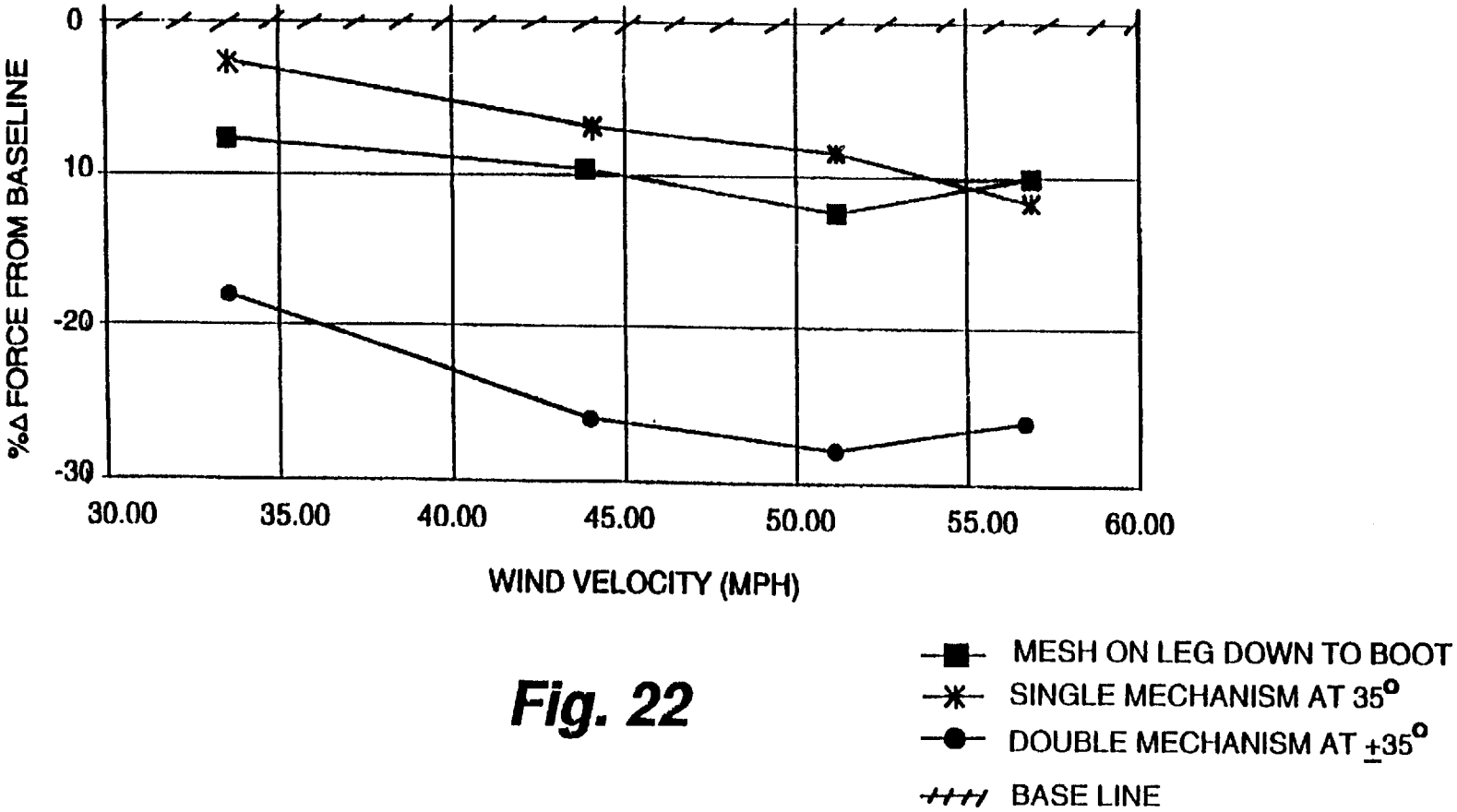
FIG. 22 is a graph illustrating the percentage change in drag force from a Baseline mannequin leg to a mannequin leg having various modifications in accordance with the present invention.
Figure 23:
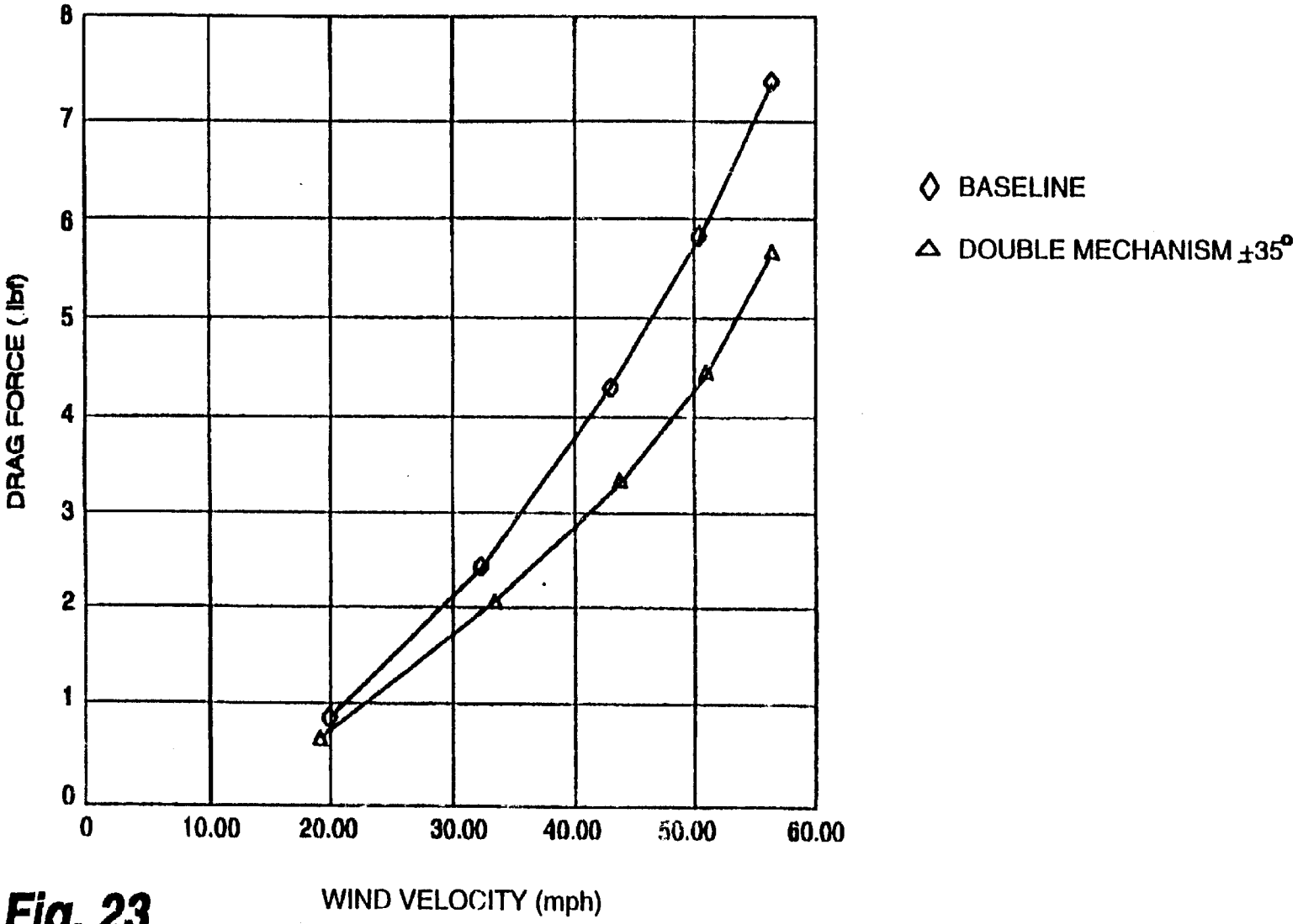
FIG. 23 is a graph illustrating the drag force at varying velocities on a mannequin leg comparing Baseline data with the use of double trip mechanisms.

A mannequin leg with a ski boot but without trip mechanisms was also tested in a wind tunnel to form a Baseline from which other data could be compared. The percentage change in drag force from the Baseline data for the mannequin leg is illustrated in FIG. 21 for various modifications to the mannequin leg. When a mesh 52, having the dimension of the aforementioned large mesh, was placed on the leg of the mannequin, as shown in FIG. 14, there was an improvement of 8–12% over the Baseline. There was also improvement over the Baseline when a single trip mechanism 22 was placed along the leg displaced 35° from the stagnation line, as illustrated in FIGS. 15 and 16, with that improvement being between 2 and 11 percent depending upon wind velocity. The most radical improvement over the Baseline, however, was obtained with a single trip mechanism 22 positioned on both sides of the stagnation line (i.e. a double trip mechanism) on the mannequin leg as illustrated in FIG. 17 with the improvements varying from 17% to 28% depending upon wind velocity.

Figure 19:
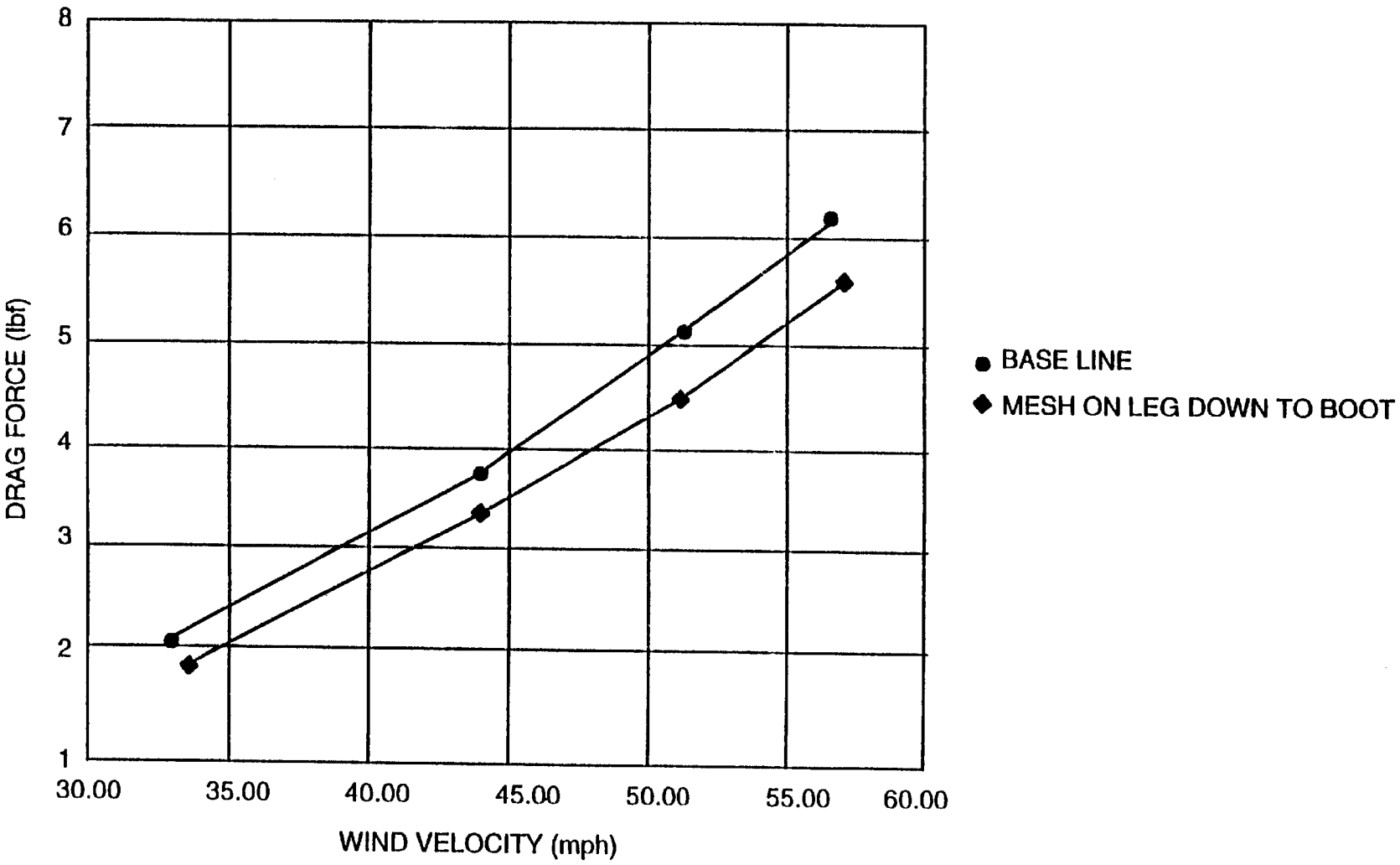
FIG. 19 is a graph illustrating the variations in drag force at various velocities comparing a Baseline mannequin leg with a mannequin leg modified with mesh on the leg down to the ski boot.

FIG. 19 is a graph comparing the Baseline mannequin leg to the mannequin leg with a mesh having the dimensions mentioned previously in connection with the large mesh. It can there be appreciated that the mesh improves the drag force on a blunt body such as a leg. The above-noted tests show that drag force is reduced, to some degree, by placing mesh on a leg and to a greater degree with the use of two spaced trip mechanisms at 35° displacements on either side of the stagnation line.

Figure 17:
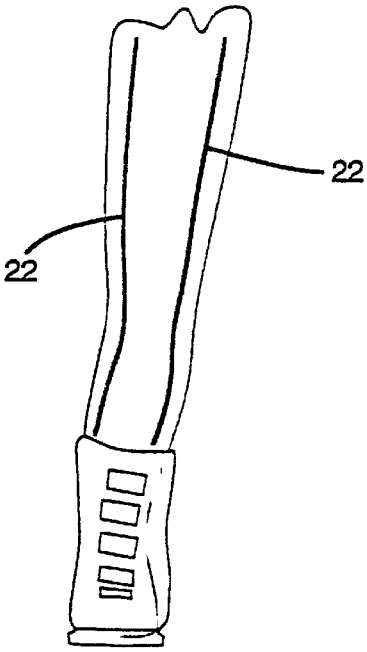
FIG. 17 is a fragmentary diagrammatic front elevation similar to FIG. 16 wherein the leg includes two elongated trip mechanisms extending on opposite sides of the stagnation line.
Figure 20:
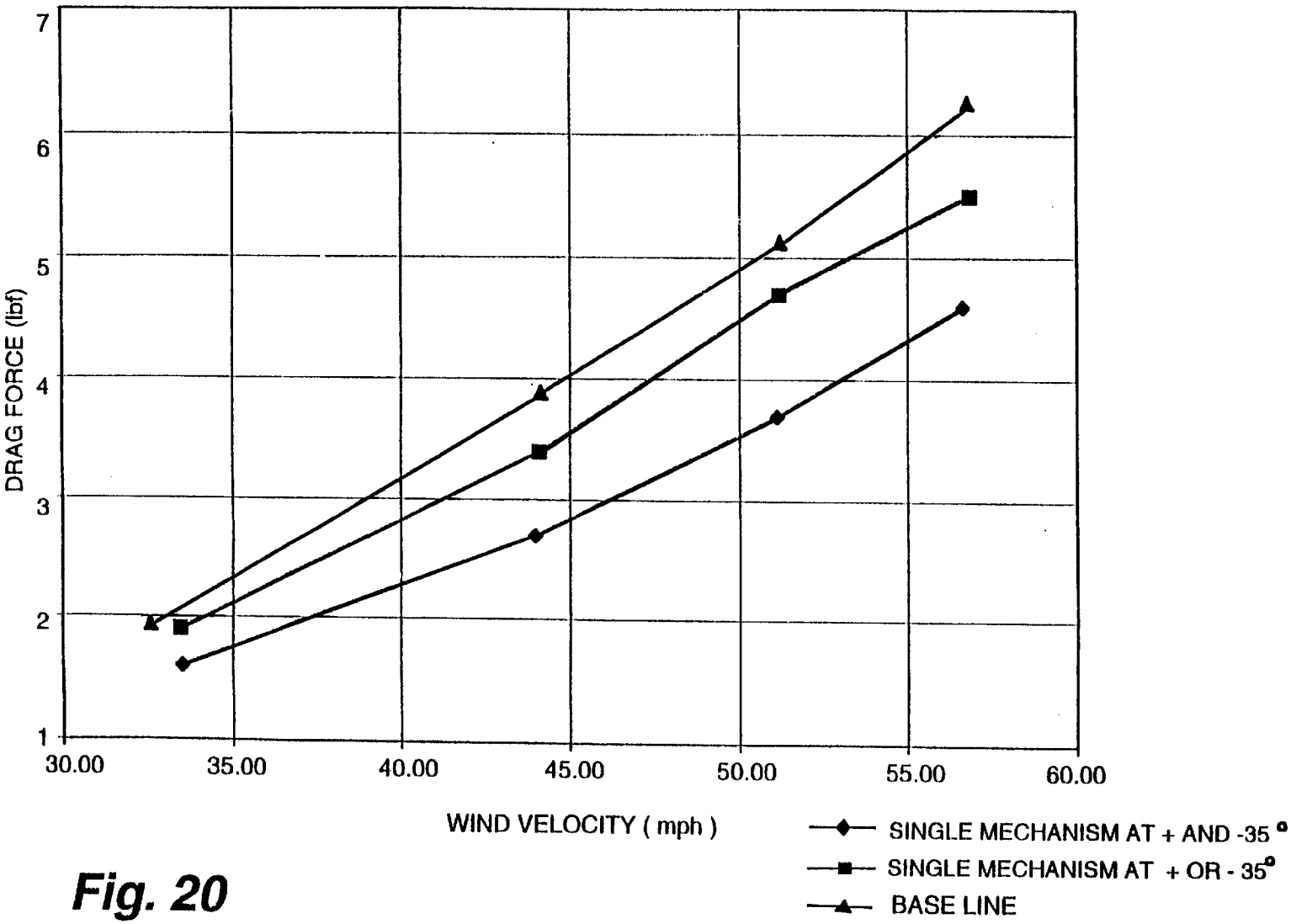
FIG. 20 is a graph making still different comparisons of drag force at various velocities to mannequin legs having been modified in accordance with the present invention.

Another graph, shown in FIG. 20, compares the Baseline mannequin leg with the use of single and double trip mechanisms as shown in FIGS. 16 and 17, respectively. When reference is made herein to double trip mechanisms, the reference is to single trip mechanisms positioned one on each side of the stagnation line. It can there be seen that the single trip mechanism at a 35° displacement from the stagnation line provides some improvement over the Baseline mannequin leg while the double trip mechanism at plus and minus 35° from the stagnation line provides even more improvement.

It will be appreciated from the above-noted wind tunnel tests that the use of tripping mechanisms to reduce drag in fact does provide sizeable benefits. Further, it can be concluded that variations in use of the tripping mechanisms on various parts of the body also improves or reduces the drag forces otherwise impeding the movement of the body through a fluid medium, increases lift, increases stability, and research indicates that heat transfer would be greatly enhanced.

Although the present invention has been described with a certain degree of particularity, it is understood that the disclosure has been made by way of example, and changes in detail or structure may be made without departing from the spirit of the invention.

The invention claimed is:

1. A system for reducing aerodynamic drag on a human body moving through a fluid medium along a line of movement, said body defining a stagnation line along a foremost substantially arcuate surface thereof in direct alignment with the line of movement, said system comprising at least one elongated protuberance fixed to the surface and extending substantially parallel to said stagnation line and being displaced from said stagnation line a predetermined distance, said protuberance being located along points of contact of tangent lines to said arcuate surface which tangent lines pass through the line of movement, and wherein the angle between said tangent line and said line of movement is in the range of 30° to 70°.

2. A system for reducing aerodynamic drag on a human body moving through a fluid medium comprising a protuberance attached to the human body to trip the boundary layer of fluid as it moves across the human body to prematurely initiate turbulence in the fluid medium, said protuberance being of substantially uniform cross-sectional size and having a cross-sectional width in the range of 0.31 to 0.13 inches.

3. A system for reducing aerodynamic drag on a human body moving through a fluid medium comprising a protuberance fixed to the human body to trip the boundary layer of fluid as it moves across the human body to prematurely initiate turbulence in the fluid medium, and riblets on the human body adjacent to said protuberance to assist in conducting the turbulence across the human body.

4. The system of claim 3 wherein said human body defines a stagnation line along a foremost substantially arcuate surface thereof in direct alignment with the line of movement, and wherein said protuberance extends substantially parallel to said stagnation line and is displaced a predetermined distance from said stagnation line.

5. The system of claim 2 herein said human body defines a stagnation line along a foremost substantially arcuate surface thereof in direct alignment with the line of movement, and wherein said protuberance extends substantially parallel to said stagnation line and is displaced a predetermined distance from said stagnation line.

6. The system of claim 5 wherein there is only a single elongated protuberance displaced from a side of said stagnation line.

7. The system of claim 6 wherein there is a single elongated protuberance on each side of said stagnation line.

8. The system of claim 1, 5 or 4 wherein there are more than one parallel protuberances displaced from a side of said stagnation line.

9. The system of claim 8 wherein there are more than one parallel protuberances displaced from each side of said stagnation line.

10. The system of claim 8 wherein there is only a single pair of protuberances displaced from a side of said stagnation line.

11. The system of claim 9 wherein there is only a single pair of protuberances displaced from each side of said stagnation line.

12. The system of claims 1, 5, 4, 7, 9, or 11 wherein said protuberance is removably connected to the surface.

13. The system of claim 1 wherein said angle is 53°.

14. The system of claim 10 or 11 wherein first and second tanget lines contact said arcuate surface, and one protuberance is displaced from said stagnation line on said arcuate surface at the point of contact of said first tangent line to said arcuate surface which said first tangent line passes through said line of movement and wherein said first tangent line forms an angle with said line of movement in the range of 30° to 40°, and a second protuberance is displaced from the stagnation line on said arcuate surface at the point of contact of said second tangent line to said arcuate surface which said second tangent line passes through said line of movement and forms an angle with said line of movement in the range of 55° to 70°.

15. The system of claim 14 wherein said one protuberance has a substantially uniform cross-sectional width in the range of 0.02 to 0.05 inches.

16. The system of claim 14 wherein said second protuberance has a substantially uniform cross-sectional width in the range of 0.05 to 0.13 inches.

17. The system of claim 15 wherein said second protuberance has a substantially uniform cross-sectional width in the range of 0.05 to 0.13 inches.

18. The system of claims 7, 1 or 5 wherein said body further includes a plurality of elongated riblets substantially perpendicularly intersecting said protuberance or protuberances.

19. The system of claim 18 wherein said riblets are substantially perpendicular to said protuberance or protuberances.

20. The system of claim 18 wherein said riblets comprise a plurality of parallel side-by-side peaks defining valleys therebetween and wherein the distance from a peak to a valley is less than 0.015 inches and the distance between peaks is in the range of 0.003 to 0.007 inches.

21. The system of claim 1 or 5 or wherein said system is an adhesive strip having said protuberance or protuberances formed thereon, said adhesive strip being releasably attachable to said body.

22. The system of claims 1, 5 or 4 wherein said system is an elastic garment with said protuberance or protuberances formed thereon.

23. The system of claim 21 wherein there are a plurality of stagnation lines on said human body and protuberances associated with said stagnation lines.

24. The system of claim 22 wherein there are a plurality of stagnation lines on said human body and protuberances associated with said stagnation lines.

25. The system of claim 23 wherein said stagnation lines extend longitudinally along the front of legs and arms of the human body.

26. The system of claim 23 wherein stagnation lines extend along the front of the shoulders from the base of the neck to the outermost part of the shoulder.

27. The system of claim 24 wherein stagnation lines extend along the front of the shoulders from the base of the neck to the outermost part of the shoulder.

28. The system of claim 22 wherein said protuberances are fiber cords secured to the garment.

29. The system of claim 22 wherein said protuberances are wires secured to the garment.

30. The system of claim 22 wherein said protuberances are gathered regions of the garment sewn to themselves.

31. The system of claim 22 wherein said garment is at least partially formed from a mesh material.

32. A system for reducing aerodynamic drag on the human body moving through a fluid medium along a line of movement, said system including a plurality of crisscrossing protuberances attached at selected portions of the human body.

33. The system of claim 32 wherein the protuberances are positioned around the arms of the human body.

34. The system of claim 32 wherein the protuberances are positioned around the legs of the human body.

35. The system of claim 32 wherein the protuberances are positioned around the head of the human body.

36. The system of claim 32 wherein there is defined on the human body at least one stagnation line and further including elongated protuberances displaced from both sides of said stagnation line defining a first region between the elongated protuberances that includes the stagnation line and a second region between the elongated protuberances that does not include the stagnation line and wherein said cross-crossing protuberances extend between the elongated protuberances only in said second region.

37. A method of reducing the drag on a human body moving along a line of movement through a fluid medium wherein a laminar flow of said fluid medium passes along said human body and is naturally converted to turbulent flow and said human body defines thereon at least one stagnation line along a foremost surface in direct alignment with the line of movement comprising the steps of providing at least one elongated protuberance fixed to the human body that is displaced from said stagnation line a predetermined distance, said protuberance being located along points of contact of tangent lines to said arcuate surface which tangent lines pass through the line of movement, and wherein the angle between said tangent line and said line of movement is in the range of 30° to 70°.

38. The method of claim 37 wherein said protuberance is provided on both sides of said protuberance.

39. The method of claim 37 further including the step of making said protuberance of substantially uniform cross-sectional size and of a cross-sectional width in the range of 0.02 to 0.13 inches.

40. A system for reducing aerodynamic drag on a human body moving through a fluid medium along a line of movement, the fluid impacting the body in a substantially normal manner, the body defining a stagnation line along a foremost substantially arcuate surface thereof in direct alignment with the line of movement, and creating a boundary layer fluid flow, having a thickness dimension, over the surface of the body as the fluid passes therealong, said system comprising:

a first elongated protuberance fixed to the surface and extending substantially parallel to the stagnation line and being displaced from the stagnation line a predetermined distance, said first protuberance being located along points of contact of a first tangent line to said arcuate surface, which first tangent line passes through the line of movement, and wherein the angle between said tangent line and said line of movement is in the range of 45° to 70°, and said first protuberance has a thickness dimension substantially equal to or greater than the thickness dimension of the boundary layer.

41. A system as defined in claim 40, wherein said protuberance has a thickness dimension greater than the thickness dimension of the boundary layer.

42. A system as defined in claim 40, further comprising:

a second protuberance fixed to the surface opposite the stagnation line from said first protuberance and extending substantially parallel to the stagnation line and being displaced from the stagnation line a predetermined distance, said second protuberance being located along points of contact of a second tangent line to said arcuate surface, which second tangent lines pass through the line of movement, and wherein the angle between said second tangent line and said line of movement is in the range of 45° to 70°, and said second protuberance has a thickness dimension substantially equal to or greater than the thickness dimension of the boundary layer.

43. A system as defined in claim 42, further comprising:

riblets intersecting said first and second protuberances in a substantially perpendicular orientation and extending in a direction away from said stagnation line.

* * * * *

UNITED STATES PATENT AND TRADEMARK OFFICE

CERTIFICATE OF CORRECTION

PATENT NO. : 5,836,016

DATED : November 17, 1998

INVENTOR(S) : David L. Jacobs, Eric L. Eagen and Jeffrey J. Rogers

It is certified that error appears in the above-identified patent and that said Letters Patent is hereby corrected as shown below:

In the claims, column 12, claim 6, line 9, delete "5" and insert --1, 5 or 4--.

Signed and Sealed this

Seventeenth Day of August, 1999

*Attest:*

*Attesting Officer*

Q. TODD DICKINSON

*Acting Commissioner of Patents and Trademarks*